US011364732B2

(12) United States Patent
Tamaki

(10) Patent No.: US 11,364,732 B2
(45) Date of Patent: Jun. 21, 2022

(54) LIQUID EJECTION DEVICE

(71) Applicant: BROTHER KOGYO KABUSHIKI KAISHA, Nagoya (JP)

(72) Inventor: Shuichi Tamaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/832,898

(22) Filed: Mar. 27, 2020

(65) Prior Publication Data

US 2020/0307282 A1 Oct. 1, 2020

(30) Foreign Application Priority Data

Mar. 28, 2019 (JP) ..... JP2019-063544
Mar. 28, 2019 (JP) ..... JP2019-063557
(Continued)

(51) Int. Cl.
*B41J 2/165* (2006.01)
*B41J 2/045* (2006.01)
(Continued)

(52) U.S. Cl.
CPC ..... *B41J 25/001* (2013.01); *B41J 2/04501* (2013.01); *B41J 2/135* (2013.01);
(Continued)

(58) Field of Classification Search
CPC .. B41J 25/001; B41J 2/04501; B41J 2/16517; B41J 2/135; B41J 2/21
See application file for complete search history.

(56) References Cited

U.S. PATENT DOCUMENTS 7,144,097 B2 12/2006 Ryo et al.
7,503,640 B2 3/2009 Sugahara et al.
(Continued)

FOREIGN PATENT DOCUMENTS

JP 2003285422 A 10/2003
JP 2004188655 A 7/2004
(Continued)

OTHER PUBLICATIONS

New U.S. patent application claiming priority to JP Applications No. 2019-063544, 2019-063557, 2019-063567 and 2019-063573, being filed concurrently with the United States Patent and Trademark Office.
(Continued)

*Primary Examiner* — Jason S Uhlenhake
(74) *Attorney, Agent, or Firm* — K&L Gates LLP

(57) ABSTRACT

The present disclosure provides a liquid ejection device to which an additional head can be attached and which suppresses a reduction in print quality. The liquid ejection device includes a main scanning drive portion that transports, in a main scanning direction, a carriage on which are mounted a base printing head that ejects ink for base printing onto a print medium, and a color printing head that ejects at least two colors of ink, from yellow, magenta, cyan, and black, onto the print medium, the base printing head and the color printing head being separated from each other in the sub-scanning direction. Between the base printing head and the color printing head on the carriage, the liquid ejection device includes an additional head attachment portion to which the additional head can be added.

13 Claims, 29 Drawing Sheets

(30) Foreign Application Priority Data

Mar. 28, 2019 (JP) ..... JP2019-063567
Mar. 28, 2019 (JP) ..... JP2019-063573

(51) Int. Cl.
*B41J 25/00* (2006.01)
*B41J 2/135* (2006.01)
*B41J 2/21* (2006.01)
*B41J 3/54* (2006.01)

(52) U.S. Cl.
CPC ..... *B41J 2/16517* (2013.01); *B41J 2/21* (2013.01); *B41J 3/543* (2013.01)

(56) References Cited

U.S. PATENT DOCUMENTS

| | | | | |
|---|---|---|---|---|
| 8,678,551 | B2 | 3/2014 | Yoshida | |
| 8,820,872 | B2 | 9/2014 | Miwa | |
| 9,085,166 | B1 | 7/2015 | Takagiwa | |
| 9,145,018 | B2 | 9/2015 | Kondo | |
| 9,193,195 | B1 | 11/2015 | Kondo | |
| 10,173,447 | B2 * | 1/2019 | Zhai | B41J 25/001 |
| 10,286,679 | B2 | 5/2019 | Ohnishi | |
| 2005/0206678 | A1 | 9/2005 | Nishino | |
| 2012/0287188 | A1 | 11/2012 | Shimada et al. | |
| 2014/0085367 | A1 * | 3/2014 | Mori | G06K 15/102 347/12 |
| 2014/0292855 | A1 | 10/2014 | Yuan et al. | |
| 2015/0328911 | A1 | 11/2015 | Garcia et al. | |
| 2018/0111398 | A1 * | 4/2018 | Ohnishi | B41J 2/21 |
| 2018/0162150 | A1 | 6/2018 | Zhai et al. | |

FOREIGN PATENT DOCUMENTS

| | | | |
|---|---|---|---|
| JP | 2004314541 | A | 11/2004 |
| JP | 2005-153382 | A | 6/2005 |
| JP | 2005254806 | A | 9/2005 |
| JP | 2007030253 | A | 2/2007 |
| JP | 2007090805 | A | 4/2007 |
| JP | 2010-241015 | A | 10/2010 |
| JP | 2011-201322 | A | 10/2011 |
| JP | 2012051279 | A | 3/2012 |
| JP | 2012183801 | A | 9/2012 |
| JP | 2012-236357 | A | 12/2012 |
| JP | 2013199037 | A | 10/2013 |
| JP | 2015-147426 | A | 8/2015 |
| JP | 2015147314 | A | 8/2015 |
| JP | 2015196250 | A | 11/2015 |
| JP | 2015-214130 | A | 12/2015 |
| JP | 2015-221582 | A | 12/2015 |
| JP | 2016000463 | A | 1/2016 |
| JP | 2017105194 | A | 6/2017 |
| JP | 2018-001674 | A | 1/2018 |
| JP | 2018065305 | A | 4/2018 |
| JP | 2019018566 | A | 2/2019 |
| WO | 2017056878 | A1 | 4/2017 |

OTHER PUBLICATIONS

Non-Final Office Action dated Apr. 1, 2021 in related U.S. Appl. No. 16/832,911.
Office Action dated Feb. 1, 2022, in corresponding Japanese Patent Application No. 2019-063573 (4 pages).
Office Action dated Feb. 22, 2022, in corresponding Japanese Patent Application No. 2019-063557 (5 pages).
Office Action dated Feb. 22, 2022, in corresponding Japanese Patent Application No. 2019-063567 (5 pages).
Office Action dated Mar. 1, 2022, in corresponding Japanese Patent Application No. 2019-063544 (18 pages).

* cited by examiner

LIQUID EJECTION DEVICE

CROSS-REFERENCE TO RELATED APPLICATION

This application claims priority to Japanese Patent Application No. 2019-63544 filed Mar. 28, 2019, Japanese Patent Application No. 2019-63557 filed Mar. 28, 2019, Japanese Patent Application No. 2019-63567 filed Mar. 28, 2019, Japanese Patent Application No. 2019-63573 filed Mar. 28, 2019. The contents of the foregoing application are hereby incorporated herein by reference.

BACKGROUND

The present disclosure relates to a liquid ejection device.

An inkjet printer is known that ejects ink used to perform base treatment on a print medium prior to ejection of printing ink. The inkjet printer is provided with a first nozzle array that is aligned along a conveyance direction (a sub-scanning direction) of printing paper and that sprays the printing ink, and a second nozzle array that is disposed in an area on an upstream side of the first nozzle array in the sub-scanning direction and that can spray the printing ink or pre-coating ink. Therefore, after the pre-coating ink is sprayed from the second nozzle array toward the print medium and a base layer is formed on the print medium, the printing ink is sprayed from the first nozzle array onto an area over which the base layer has been formed. Thus, penetration of the printing ink into the print medium is suppressed.

SUMMARY

However, in the known inkjet printer, a head for color having the first nozzle array is disposed on a downstream side, in the sub-scanning direction, of a head mounting portion for base printing that has the second nozzle array. Therefore, there is a problem that an additional head cannot be mounted. Further, when the first nozzle array and the second nozzle array are close to each other in the sub-scanning direction, the printing ink is sprayed before the base layer is formed using the pre-coating ink. Thus, the penetration of the printing ink into the print medium is not suppressed, and there is a possibility of a deterioration in print quality.

Embodiments of the broad principles derived herein provide a liquid ejection device to which an additional head can be attached and which can suppress a deterioration in print quality.

A liquid ejection device according to a first aspect of the present disclosure includes: a first head configured to eject a first liquid; a second head configured to eject a second liquid different from the first liquid; a movement mechanism configured to transport, in a main scanning direction, a carriage on which the first head and the second head are mounted, the first head and the second head being separated from each other in a sub-scanning direction, an additional head attachment portion being provided between the first head and the second head on the carriage; and an additional head configured to be additionally attached to the additional head attachment portion. In this case, by selectively attaching the additional head to the additional head attachment portion, it is possible to correspond to a variety of printing.

A liquid ejection device according to a second aspect of the present disclosure includes: a first head configured to eject a first liquid; a second head configured to eject a second liquid different from the first liquid; and a movement mechanism configured to transport, in a main scanning direction, a carriage on which the first head and the second head are mounted, the first head and the second head being separated from each other in a sub-scanning direction. On the carriage, the first head and the second head are disposed separated from each other in the sub-scanning direction, by a distance that is equal to or greater than a length in the sub-scanning direction of the head, of the first head and the second head, for which a length of a nozzle array in the sub-scanning direction is shorter. When the carriage moves in the sub-scanning direction and ejection is performed from the first head and the second head, a time period is secured for a liquid initially ejected onto a print medium to permeate the print medium, and a deterioration in print quality can be suppressed.

BRIEF DESCRIPTION OF THE DRAWINGS

Embodiments will be described below in detail with reference to the accompanying drawings in which.

DETAILED DESCRIPTION

Figure 1:
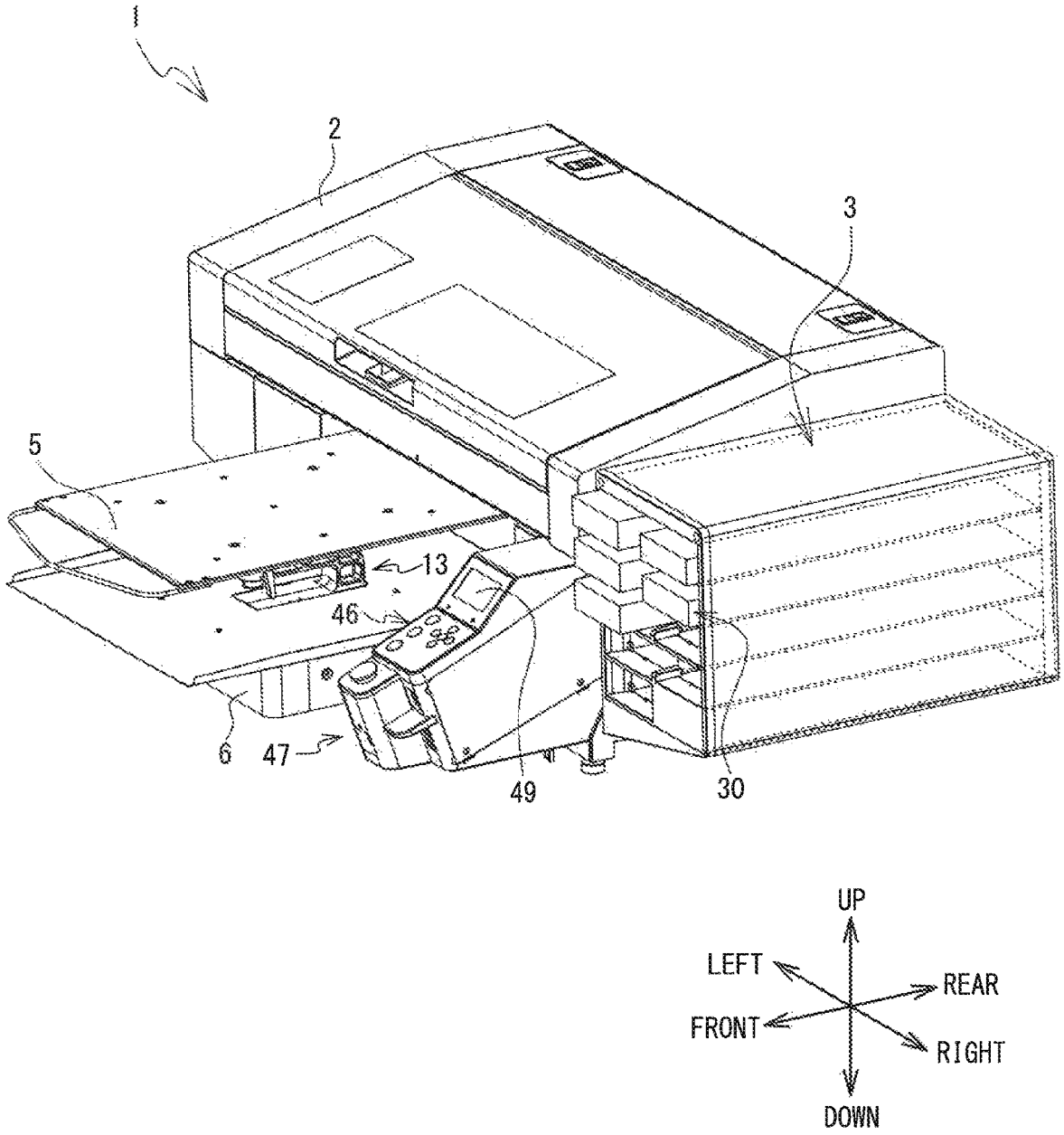
FIG. 1 is a perspective view of a printer 1.

The configuration of a printer 1 of the present disclosure will be explained with reference to FIG. 1. The upper side, the lower side, the lower left side, the upper right side, the lower right side and the upper left side of FIG. 1 respectively correspond to the upper side, the lower side, the front side, the rear side, the right side and the left side of the printer 1.

Mechanical Configuration of Printer 1

The printer 1 is a serial type inkjet printer that performs printing by ejecting a liquid onto a print medium (not shown in the drawings), which is a fabric, such as a T-shirt, or paper etc. For example, the printer 1 prints a color image on the print medium by downwardly ejecting five different types of ink (white (W), black (K), yellow (Y), cyan (C) and magenta (M)) as the liquid. In the following explanation, of the five types of ink, the white color ink is referred to as white ink. When the four colors of ink, i.e., the black, cyan, yellow and magenta inks, are collectively referred to, they are referred to as color ink.

Figure 2:
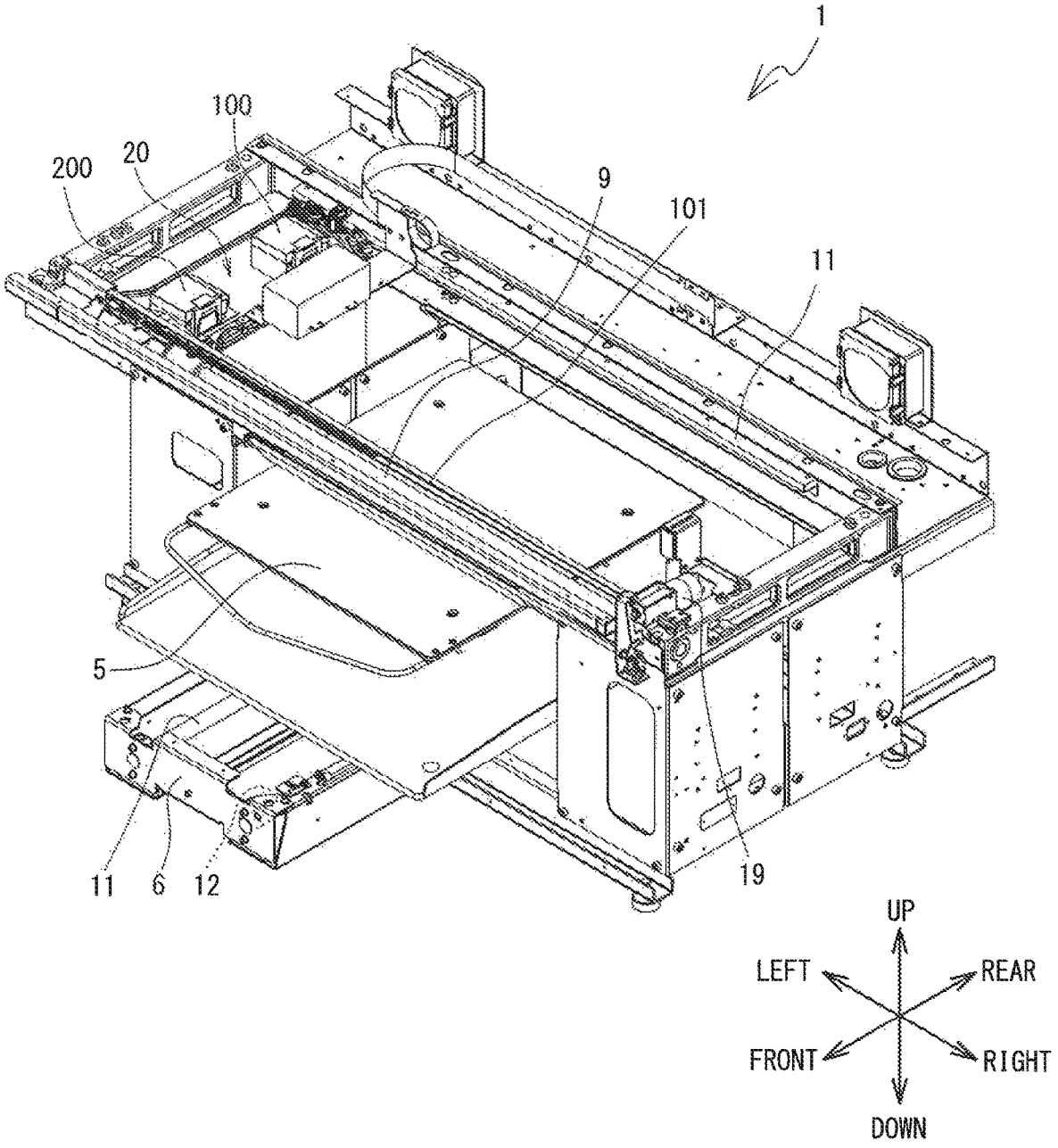
FIG. 2 is a perspective view of the printer 1 when a housing 2 has been removed.

As shown in FIG. 1 and FIG. 2, the printer 1 is provided with a housing 2, a platen drive mechanism 6, a platen 5, a frame body 10, a guide shaft 9, a rail 11, a carriage 20, heads 100 and 200, a drive belt 101, a drive motor 19, maintenance portions 141 and 142 (refer to FIG. 3) provided in a non-printing area 140 to be described later, and the like. The housing 2 has a box shape, and has openings provided respectively in the front surface and the rear surface thereof. An operation portion 47 is provided at a front position on the right side of the housing 2. The operation portion 47 is provided with a display 49 and operation buttons 46.

The platen drive mechanism 6 uses, as a drive source, a motor (not shown in the drawings) provided at a rear end portion thereof, and moves the platen 5 in the front-rear direction of the housing 2 (hereinafter also referred to as a "sub-scanning direction") along a pair of guide rails (not shown in the drawings). The platen 5 has a plate shape. The print medium, which is a fabric such as a T-shirt, is placed on the upper surface of the platen 5.

Figure 18:
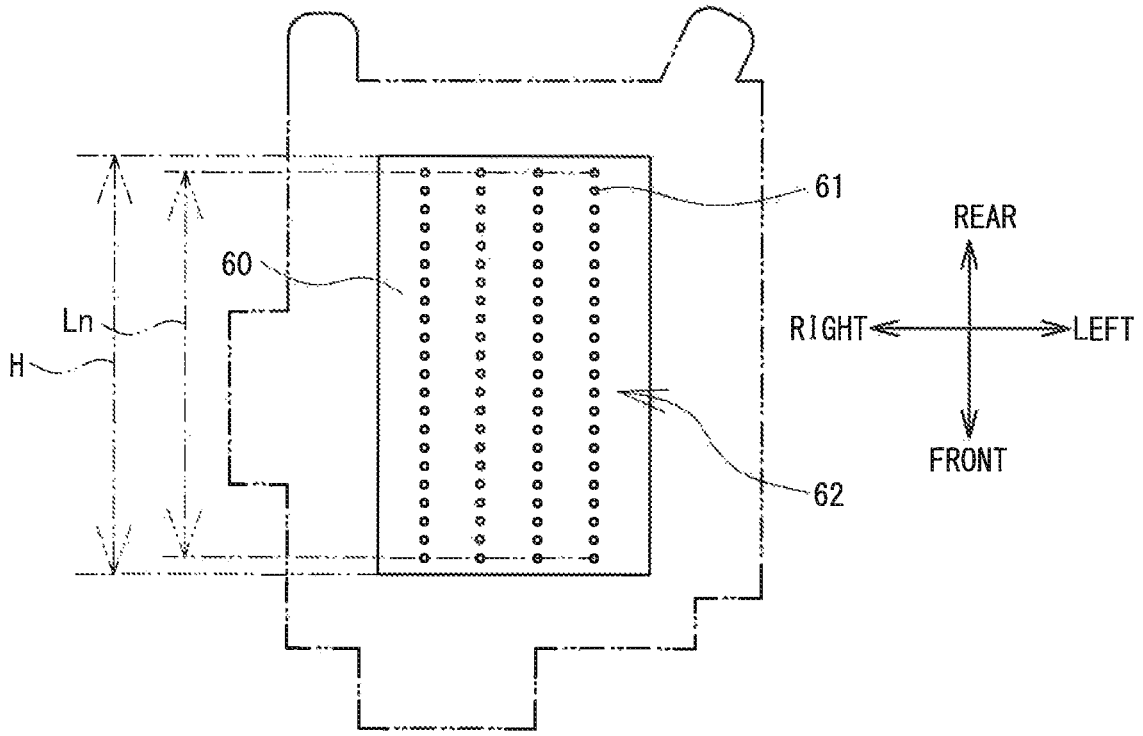
FIG. 18 is a diagram showing a nozzle surface 60 of a head.

The frame body 10 is disposed on an upper portion of the housing 2. The frame body 10 supports the guide shaft 9 and the rail 11 on the inside thereof. The carriage 20 is supported such that it can be conveyed in the left-right direction (hereinafter also referred to as a "main scanning direction") along the guide shaft 9. The heads 100 and 200, and an additional head 300 to be described later are mounted on the carriage 20. The head 100 is positioned to the rear of the head 200. As shown in FIG. 18, a nozzle surface 60 is provided on the bottom surface of each of the heads 100 and 200 and the additional head 300. The nozzle surface 60 is provided with a plurality of nozzle arrays 62 that are provided with a plurality of fine nozzles 61 in the front-rear direction. A nozzle length Ln is the length of the nozzle array 62 in the front-rear direction. Ink droplets are downwardly ejected from the nozzles 61 as a result of driving of piezoelectric elements. When printing is performed on the print medium when the platen 5 moves from the rear side to the front side, the rear side of the nozzle surface 60 is an upstream side (a side on which the printing is first performed) in the sub-scanning direction. Hereinafter, the head 100 is also referred to as the base printing head 100, and the head 200 is also referred to as the color printing head 200. At a printing start position in each of the head 200, the head 100 and the additional head 300, the nozzles used for printing that are on the rearmost side of each of the heads are positioned on the rearmost side of a printing area. The length of the nozzle surface 60 in the sub-scanning direction is a length H. It is sufficient that the respective heads have the same outer shape and the nozzle surface 60 even when the inks ejected therefrom are different. Note that the ink ejected from the base printing head 100 may be the white ink, or may be a discharge printing ink used to decolor the print medium.

The drive belt 101 is stretched along the left-right direction on the inside of the frame body 10. The drive motor 19 can rotate forward and rearward and is coupled to the carriage 20 via the drive belt 101. The printing on the print medium is performed by the inks being ejected from the heads 100, 200 and 300, which reciprocate in the left-right direction as a result of the driving of the drive motor 19, while the platen 5 conveys the print medium in the front-rear direction.

A mounting portion 3 is provided on the right side of the printer 1. A cartridge 30 is connected to the mounting portion 3. The cartridge 30 supplies the liquid stored therein to the head.

Structures of Maintenance Portions

Figure 3:
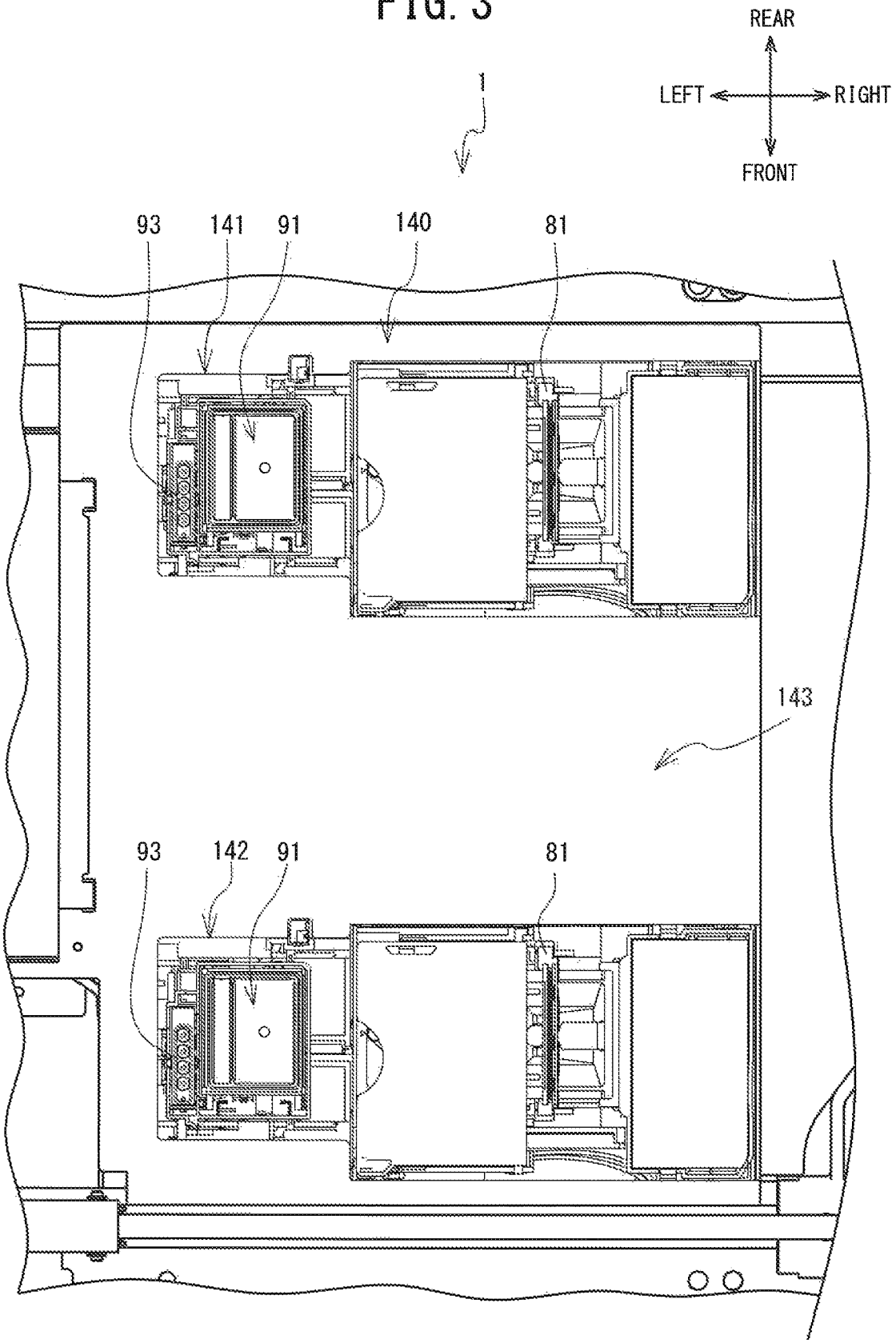
FIG. 3 is a plan view of structures of maintenance portions 141 and 142.

As shown in FIG. 3, in the non-printing area 140, maintenance portions 141 and 142 are respectively provided below movement paths of the heads 100 and 200. Each of the maintenance portions 141 and 142 is provided with a wiper 81, a nozzle cap 91, an exhaust cap 93 and the like. In the maintenance portions 141 and 142, maintenance operations, such as purging, nozzle surface wiping and the like, are performed in order to restore an ink ejection performance of the heads 100 and 200 and to secure print quality of the printer 1. The purging is an operation to discharge the ink including foreign matter, air bubbles and the like from the heads 100 and 200 etc. when each of the heads 100 and 200 is covered by the nozzle cap 91 and the exhaust cap 93. Thus, the ink including the foreign matter, the air bubbles and the like is sucked from the heads 100 and 200, and it is possible to reduce a possibility of an ejection failure occurring in the heads 100 and 200. The nozzle wiping is an operation in which the wiper 81 is used to wipe off the ink etc. remaining on the surface of the nozzle surface 60 of each of the heads 100 and 200. An open space 143 for a maintenance portion that performs maintenance of the additional head 300 is provided between the maintenance portions 141 and 142.

Electrical Configuration of Printer 1

Figure 4:
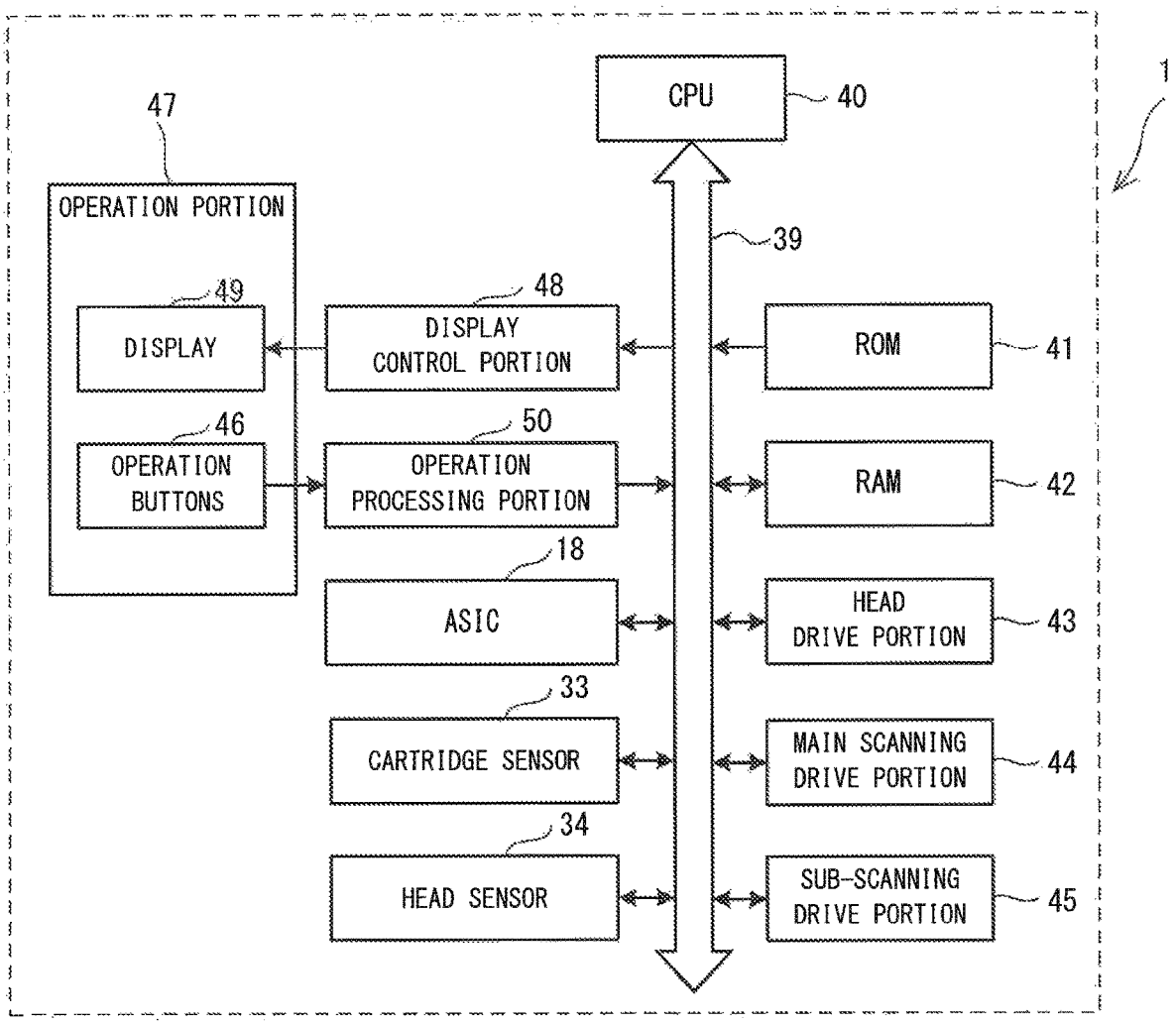
FIG. 4 is a block diagram showing an electrical configuration of the printer 1.

As shown in FIG. 4, the printer 1 is provided with a CPU 40 that controls the printer 1. A ROM 41, a RAM 42, a head drive portion 43, a main scanning drive portion 44, a sub-scanning drive portion 45, an ASIC 18, a display control portion 48, an operation processing portion 50, a cartridge sensor 33 and a head sensor 34 are electrically connected to the CPU 40 via a bus 39.

The ROM 41 stores a control program, initial values and the like that are used by the CPU 40 to control operations of the printer 1. The RAM 42 temporarily stores various data, flags and the like that are used in the control program. The head drive portion 43 is electrically connected to the heads 100 and 200. The head drive portion 43 drives the piezoelectric elements respectively provided in ejection channels of the heads 100 and 200 (refer to FIG. 2), and causes the ink to be ejected from the nozzles.

The main scanning drive portion 44 includes the drive motor 19 (refer to FIG. 2) and causes the carriage 20 to move in the main scanning direction. The sub-scanning drive portion 45 drives the platen drive mechanism 6 (refer to FIG. 1 and FIG. 2) and causes the platen 5 (refer to FIG. 1) to move in the sub-scanning direction. The ASIC 18 controls the head drive portion 43, the main scanning drive portion 44 and the sub-scanning drive portion 45. The cartridge sensor 33 detects attachment/detachment and a type of the cartridge 30. The head sensor 34 detects a type of the head attached to an additional head attachment portion 310. The head sensor 34 is provided on the additional head attachment portion 310, and is configured by a plurality of microswitches, for example. The head sensor 34 detects unevenness of the additional head 300 and detects the type of the additional head 300. The CPU 40 can cause the heads 100, 200 and 300 to eject the respective inks, regardless of whether the carriage 20 moves to the left or to the right. The CPU 40 can cause the heads 100, 200 and 300 to eject the respective inks, regardless of whether the platen 5 moves to the front or to the rear.

Structure of Carriage 20A

The carriage 20A, which is a first working example of the carriage 20, will be explained with reference to FIG. 5. The carriage 20A is a rectangle that is long in the front-rear direction. A head attachment portion 110 is provided on the rear side of the carriage 20A. The base printing head 100 is attached to the head attachment portion 110. An example of the head 100 is a white ink head. An opening (not shown in the drawings) to downwardly expose a nozzle surface (not shown in the drawings) provided on the lower surface of the head 100, and a screw hole (not shown in the drawings) to fix the head 100 are provided in the head attachment portion 110. A head attachment portion 210 is provided on the front side of the carriage 20A. The color printing head 200 is attached to the head attachment portion 210. Examples of the head 200 are heads for yellow, magenta, cyan and black inks. An opening (not shown in the drawings) to downwardly expose a nozzle surface (not shown in the drawings) provided on the lower surface of the head 200, and a screw hole (not shown in the drawings) to fix the head 200 are provided in the head attachment portion 210. Further, the head 100 and the head 200 are disposed so as to be separated from each other in the sub-scanning direction. A distance of separation between the rear end of the nozzle arrays 62 (refer to FIG. 18) of the head 100 and the rear end of the nozzle arrays 62 (refer to FIG. 18) of the head 200 is denoted by La.

Figure 5:
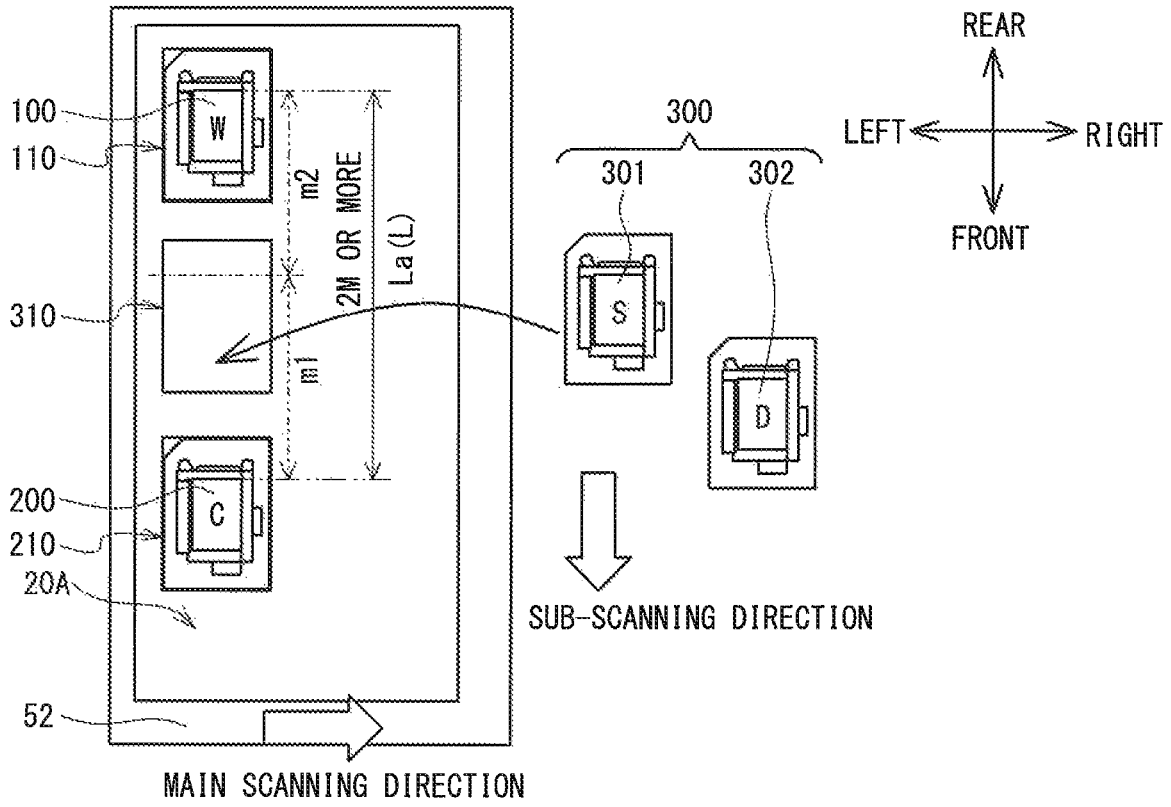
FIG. 5 is a plan view of a carriage 20A.

As shown in FIG. 5, the additional head attachment portion 310 is provided between the head attachment portion 110 and the head attachment portion 210. The additional head 300 is attached to the additional head attachment portion 310. The additional head 300 is, for example, a special ink head 301 that ejects a special ink, which is a specific color ink, or a discharge printing ink head 302 that ejects the discharge printing ink used to decolor the print medium. Examples of the special ink include fluorescent color, gold, silver, metallic color, pastel color and the like, which are colors different from yellow, magenta, cyan, black and white. In each of the drawings, the head for white (which is the base printing head 100) is denoted by "W," and the head for yellow, magenta, cyan and black (which is the color printing head 200) is denoted by "C." Further, the special ink head 301 is denoted by "S," and the discharge printing ink head 302 is denoted by "D."

In FIG. 5, when the single additional head 300 is virtually disposed between the head 100 and the head 200, m1 is a distance between the rear end of the nozzle arrays 62 (refer to FIG. 18) of the head 200 and the rear end of the nozzle arrays 62 (refer to FIG. 18) of the additional head 300, and m2 is a distance between the rear end of the nozzle arrays 62 (refer to FIG. 18) of the head 100 and the rear end of the nozzle arrays 62 (refer to FIG. 18) of the additional head 300. It is defined that La=m1+m2. In the explanation below, the distance of separation between the two heads indicates the distance of separation between the rear ends of the nozzle arrays 62 (refer to FIG. 18) of each of the heads. It is assumed that the additional head 300, the head 100 and the head 200 are arranged in a straight line in the sub-scanning direction and that the nozzle arrays thereof are also arranged in a straight line in the sub-scanning direction. In FIG. 5, the distance of separation (hereinafter also referred to as a "bleeding inhibition distance") between the head 100 and the additional head 300, which is provided in order to inhibit the ink from bleeding even when the ink is ejected from the additional head 300 onto the ink ejected from the head 100, is denoted by M. In addition, M also indicates the bleeding inhibition distance between the additional head 300 and the head 200, which is provided in order to inhibit the ink from bleeding even when the ink is ejected from the head 200 onto the ink ejected from the additional head 300. The bleeding inhibition distance M is calculated using the same mathematical expression (Expression 1) as that used to calculate L to be described later. Magnitude correlations between La, m1, m2 and M are $m1 \geq M$, $m2 \geq M$, and $La = m1 + m2 \geq 2M$. Therefore, in FIG. 5, even if the single additional head 300 is disposed between the head 100 and the head 200, since m1 and m2 are equal to or larger than M ($m1 \geq M$, $m2 \geq M$), the bleeding relating to the ink of the additional head 300 is inhibited.

Further, in the printer 1, the head 100 and the head 200 may be disposed on the carriage 20 such that the head 100 and the head 200 are separated from each other in the sub-scanning direction by more than the length, in the sub-scanning direction, of one of the head 100 and the head 200 for which the length Ln (refer to FIG. 18) of the nozzle array in the sub-scanning direction is shorter.

Structure of Carriage 20B

The carriage 20B, which is a second working example of the carriage 20, will be explained with reference to FIG. 6. The carriage 20B is a rectangle that is long in the front-rear direction. Similarly to the carriage 20A of the first working example, the carriage 20B is provided with a head attachment portion 110A, an additional head attachment portion 310A and a head attachment portion 210A, to the left of the center of the carriage 20B and from the rear side toward the front side of the carriage 20B. A head attachment portion 110B, an additional head attachment portion 310B and a head attachment portion 210B are provided from the rear side toward the front side, to the right of the head attachment portion 110A, the additional head attachment portion 310A and the head attachment portion 210A. The head attachment portion 110B is provided so as to be displaced forward from the head attachment portion 110A by a predetermined length. The additional head attachment portion 310B is also provided so as to be displaced forward from the additional head attachment portion 310A by a predetermined length. The head attachment portion 210B is also provided so as to be displaced forward from the head attachment portion 210A by a predetermined length.

Structures of the attachment portions 110A and 110B, the additional head attachment portions 310A and 310B, and the head attachment portions 210A and 210B are respectively the same as those of the head attachment portion 110, the additional head attachment portion 310 and the head attachment portion 210 of the carriage 20A of the first working example. White ink heads 101A and 101B are attached to the head attachment portions 110A and 110B. Color printing heads 201A and 201B are attached to the head attachment portions 210A and 210B. Additional heads are not attached to the additional head attachment portions 310A and 310B. A distance of separation between the head 101A and the head 201A in the sub-scanning direction is denoted by Lb.

Figure 6:
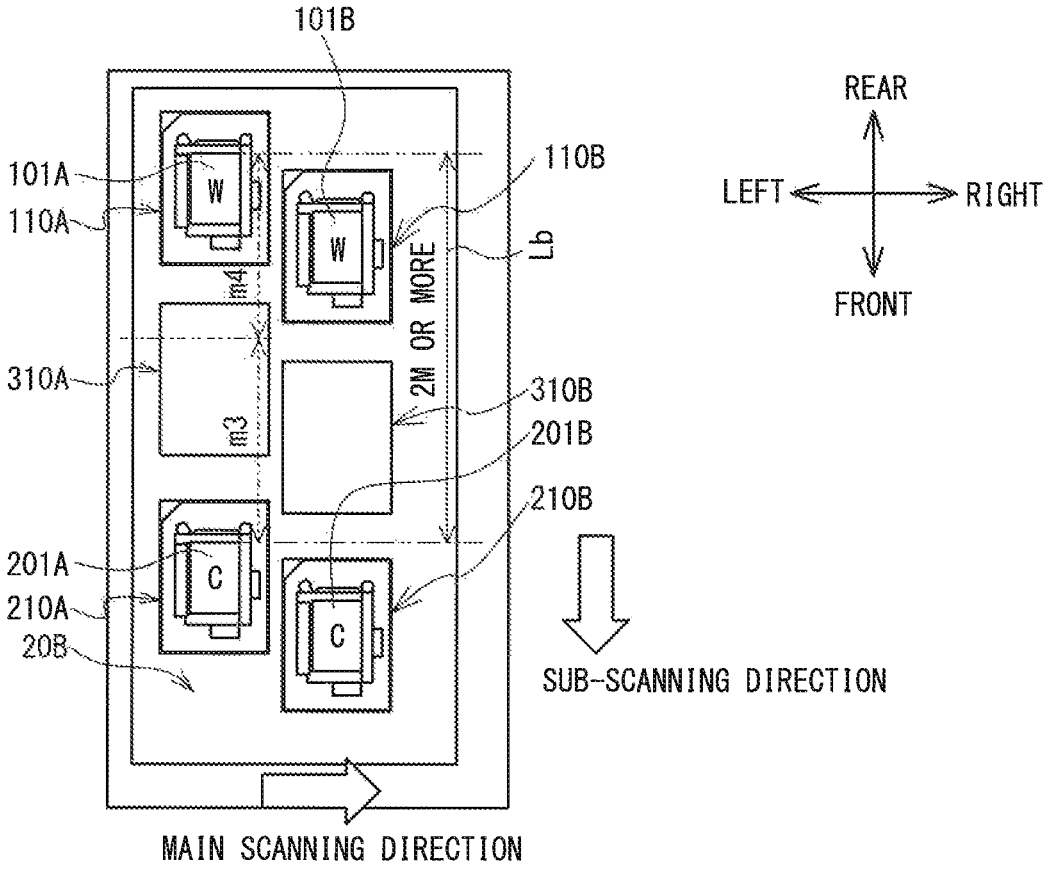
FIG. 6 is a plan view of a carriage 20B.

In FIG. 6, m3 and m4 are distances estimated in the same manner as in FIG. 5 when the single additional head 300 is virtually disposed between the head 101A and the head 201A. It is defined that Lb=m3+m4. In FIG. 6, it is assumed that the additional head 300, the head 101A and the head 201A are arranged in a straight line in the sub-scanning direction and that the nozzle arrays thereof are also arranged in a straight line in the sub-scanning direction. M is the bleeding inhibition distance of the head 101A or the head 201A with respect to the additional head 300, and is calculated using the same mathematical expression as that used to calculate L to be described later. Magnitude correlations between Lb, m3, m4 and M are m3≥M, m4≥M, and Lb=m3+m4≥2M. Therefore, in FIG. 6, even if the single additional head 300 is disposed between the head 101A and the head 201A, the bleeding relating to the ink of the additional head 300 is inhibited.

Figure 7:
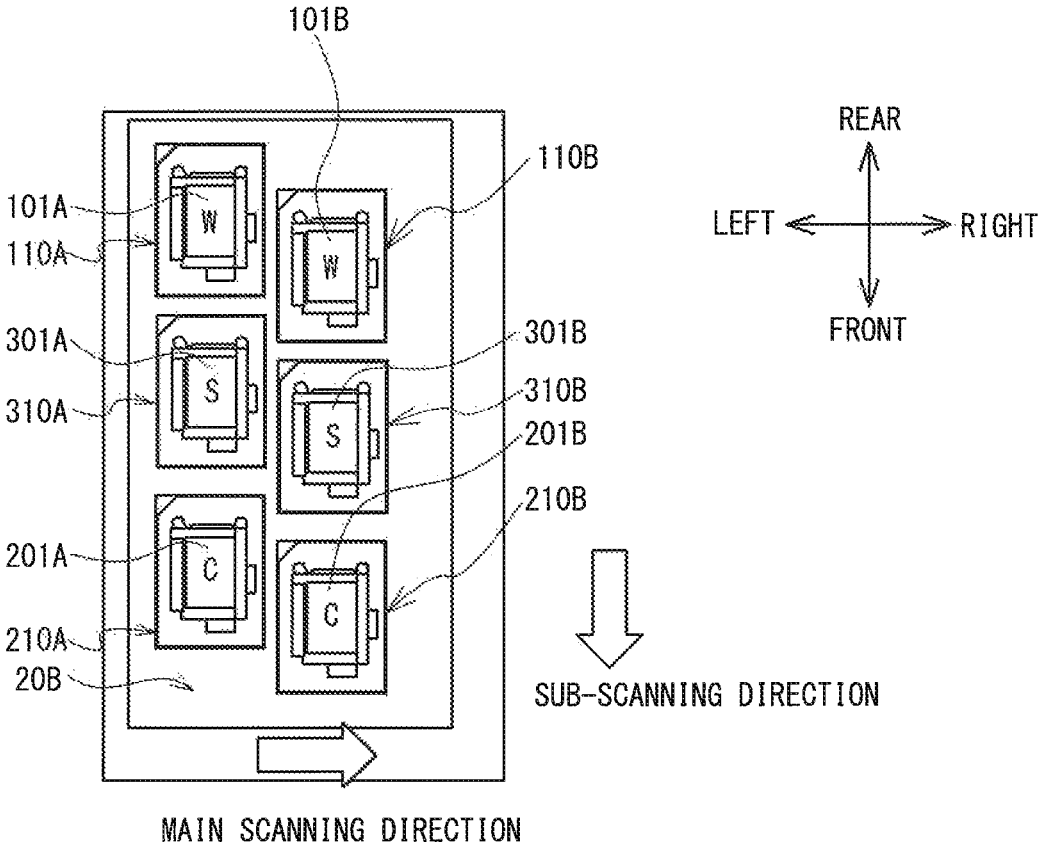
FIG. 7 is a plan view of the carriage 20B.

FIG. 7 shows a state in which special ink heads 301A and 301B are respectively attached to the additional head attachment portions 310A and 310B of the carriage 20B of the second working example shown in FIG. 6. The discharge printing ink head 302 (refer to FIG. 5) may be attached to each of the additional head attachment portions 310A and 310B, or the discharge printing ink head 302 may be attached to the additional head attachment portion 310A and the special ink head 301B may be attached to the additional head attachment portion 310B. The special ink head 301A may be attached to the additional head attachment portion 310A, and the discharge printing ink head 302 (refer to FIG. 5) may be attached to the additional head attachment portion 310B.

Structure of Carriage 20C

Figure 8:
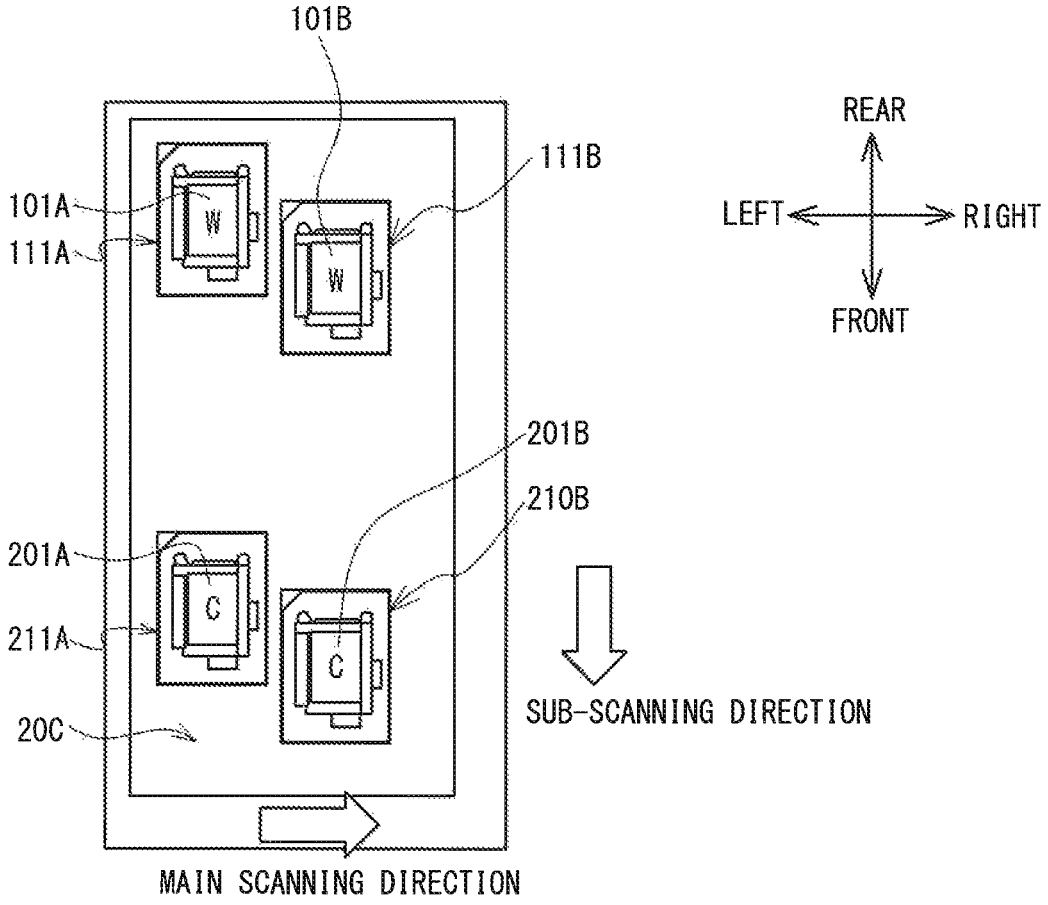
FIG. 8 is a plan view of a carriage 20C.

The carriage 20C, which is a third working example of the carriage 20, will be explained with reference to FIG. 8. The carriage 20C is a rectangle that is long in the front-rear direction. A head attachment portion 111A is provided to the left of the center of the carriage 20C and on the rear side of the carriage 20C. An example of a first head that is attached to the head attachment portion 111A is the white ink head 101A or a discharge printing ink head 302A. An opening (not shown in the drawings) to downwardly expose a nozzle surface (not shown in the drawings) provided on the lower surface of the first head, and a screw hole (not shown in the drawings) to fix the first head are provided in the head attachment portion 111A. A head attachment portion 211A is provided on the front side of the carriage 20C. An example of a second head that is attached to the head attachment portion 211A is the color printing head 201A or the special ink head 301A. Further, an opening (not shown in the drawings) to downwardly expose a nozzle surface (not shown in the drawings) provided on the lower surface of the second head, and a screw hole (not shown in the drawings) to fix the second head are provided in the head attachment portion 211A. In this way, the first head and the second head are disposed so as to be separated from each other in the sub-scanning direction that is orthogonal to the main scanning direction. In contrast to the carriage 20B, the additional head attachment portion is not provided between the head attachment portion 111A and the head attachment portion 211A.

A head attachment portion 111B and a head attachment portion 211B are provided on the carriage 20C from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. Structures of the head attachment portion 111B and the head attachment portion 211B are respectively the same as those of the head attachment portion 111A and the head attachment portion 211A. An example of the first head that is attached to the head attachment portion 111B is the white ink head 101B or a discharge printing ink head 302B. An example of the second head that is attached to the head attachment portion 211B is the color printing head 201B or the special ink head 301B. In FIG. 8, the white ink heads 101A and 101B are attached to the head attachment portions 111A and 111B of the carriage 20C. The color printing heads 201A and 201B are attached to the head attachment portions 211A and 211B.

The white ink heads 101A and 101B may respectively be attached to the head attachment portions 111A and 111B of the carriage 20C, the color printing head 201A may be attached to the head attachment portion 211A, and the special ink head 301B may be attached to the second head attachment portion 211B. The discharge printing ink head 302A may be attached to the head attachment portion 111A, the white ink head 101B may be attached to the head attachment portion 111B, and the color printing heads 201A and 201B may respectively be attached to the head attachment portions 211A and 211B. The discharge printing ink heads 302A and 302B may respectively be attached to the head attachment portions 111A and 111B, and the color printing heads 201A and 201B may respectively be attached to the head attachment portions 211A and 211B.

Structure of Carriage 20D

The carriage 20D, which is a fourth working example of the carriage 20, will be explained with reference to FIG. 9. The carriage 20D is a rectangle that is long in the front-rear direction. The head attachment portion 111A is provided on the leftmost side of and on the rear side of the carriage 20D. An example of the first head that is attached to the head attachment portion 111A is the white ink head 101A. The opening (not shown in the drawings) to downwardly expose the nozzle surface (not shown in the drawings) provided on the lower surface of the first head, and the screw hole (not shown in the drawings) to fix the first head are provided in the head attachment portion 111A. The head attachment portion 211A is provided to the front of the head attachment portion 111A. An example of the second head that is attached to the head attachment portion 211A is the color printing head 201A. The opening (not shown in the drawings) to downwardly expose the nozzle surface (not shown in the drawings) provided on the lower surface of the second head, and the screw hole (not shown in the drawings) to fix the second head are provided in the head attachment portion 211A. The first head and the second head are disposed so as to be separated from each other in the sub-scanning direction that is orthogonal to the main scanning direction. The additional head attachment portion is not provided between the head attachment portion 111A and the head attachment portion 211A.

Figure 9:
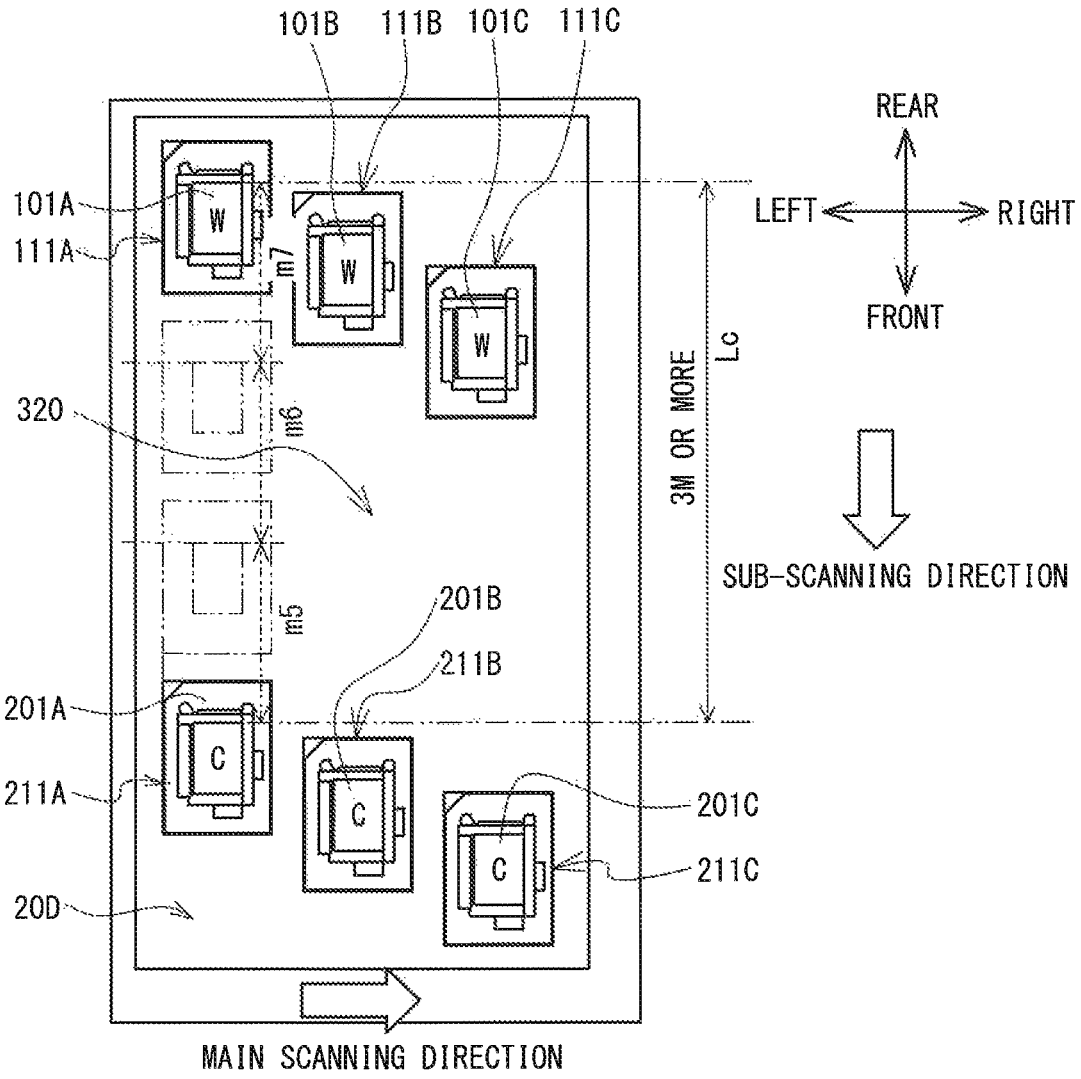
FIG. 9 is a plan view of a carriage 20D.

In FIG. 9, m5 to m7 are distances of separation estimated in the same manner as in FIG. 5 when two virtual heads (shown by dotted lines) corresponding to the additional heads 300 are virtually disposed between the head 101A and the head 201A so as to be arranged in a row in the sub-scanning direction. It is defined that Lc=m5+m6+m7. In FIG. 9, M indicates the bleeding inhibition distance of the head 101A or the head 201A with respect to the two virtual heads corresponding to the additional heads 300. M is calculated using the same mathematical expression as that used to calculate L to be described later. Magnitude correlations between Lc, m5, m6, m7 and M are m5≥M, m6≥M, m7≥M, and Lc=m5+m6+m7≥3M. Therefore, as shown in FIG. 9, even if the two virtual heads corresponding to the additional heads 300 are aligned in the sub-scanning direction and disposed between the head 101A and the head 201A, the bleeding relating to the ink of the virtual heads corresponding to the additional heads 300 is inhibited.

The head attachment portion 111B and the head attachment portion 211B are provided from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. A head attachment portion 111C and a head attachment portion 211C are provided on the carriage 20D from the rear side toward the front side, to the right of the head attachment portion 111B and the head attachment portion 211B. The additional head attachment portion is not provided between the head attachment portion 111C and the head attachment portion 211C. The head attachment portion 111C is provided so as to be displaced forward from the head attachment portion 111B by a predetermined length. The head attachment portion 211C is also provided so as to be displaced forward from the head attachment portion 211B by a predetermined length. Structures of the head attachment portions 111B and 111C and of the head attachment portions 211B and 211C are respectively the same as those of the head attachment portion 111A and the head attachment portion 211A. Examples of the first heads that are attached to the head attachment portions 111A to 111C are the white ink head 101A to a white ink head 101C. Examples of the second heads that are attached to the head attachment portions 211A to 211C are the color printing head 201A to a color printing head 201C.

Structure of Carriage 20E

Figure 10:
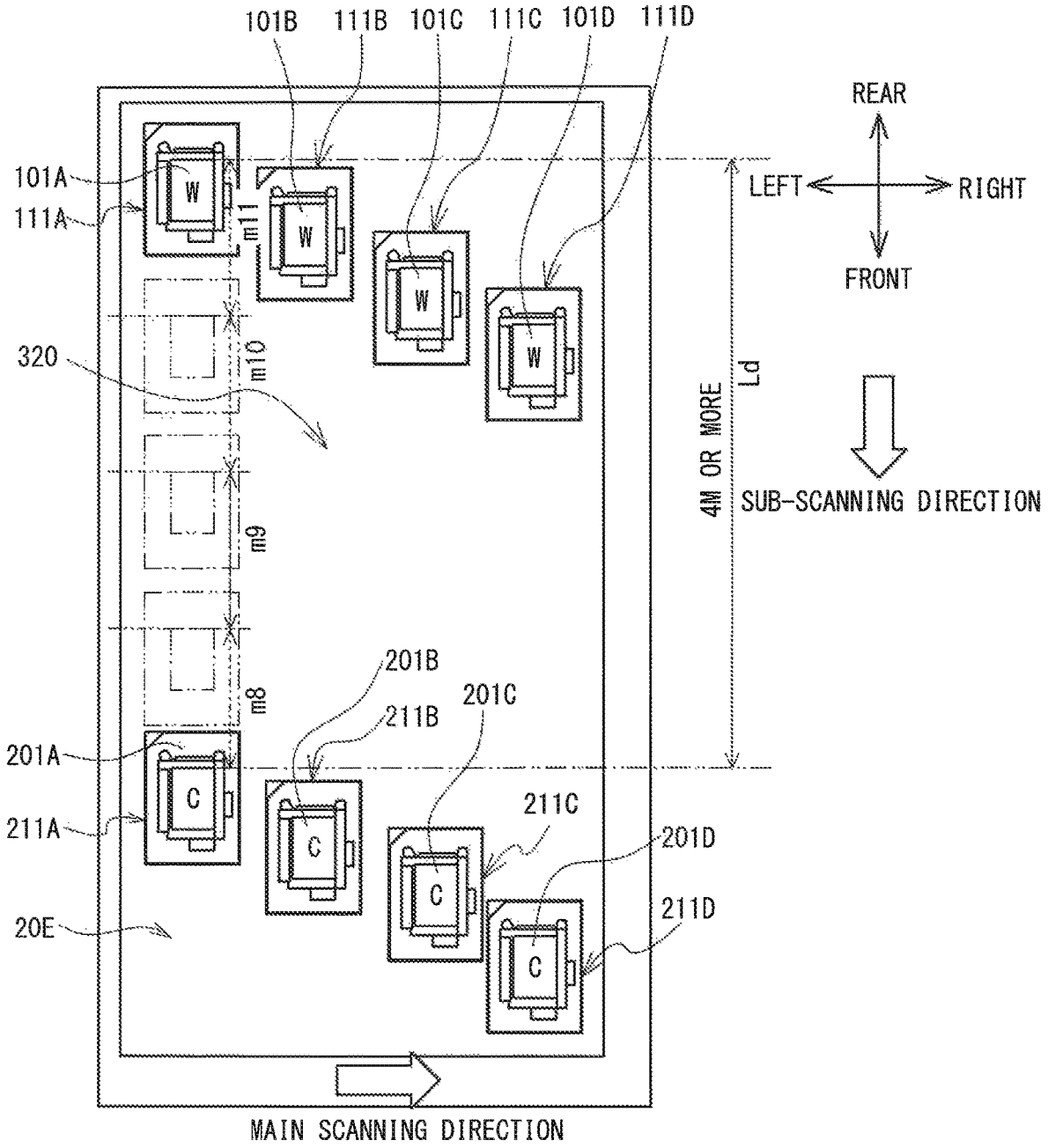
FIG. 10 is a plan view of a carriage 20E.

The carriage 20E, which is a fifth working example of the carriage 20, will be explained with reference to FIG. 10. The carriage 20E is a rectangle that is long in the front-rear direction. As shown in FIG. 10, the head attachment portion 111A is provided on the leftmost side of and on the rear side of the carriage 20E. An example of the first head that is attached to the head attachment portion 111A is the white ink head 101A. The opening (not shown in the drawings) to downwardly expose the nozzle surface (not shown in the drawings) provided on the lower surface of the first head, and the screw hole (not shown in the drawings) to fix the first head are provided in the head attachment portion 111A. The head attachment portion 211A is provided on the front side of the carriage 20E. An example of the second head that is attached to the head attachment portion 211A is the color printing head 201A. The opening (not shown in the drawings) to downwardly expose the nozzle surface (not shown in the drawings) provided on the lower surface of the second head, and the screw hole (not shown in the drawings) to fix the second head are provided in the head attachment portion 211A. The first head and the second head are disposed so as to be separated from each other in the sub-scanning direction that is orthogonal to the main scanning direction. The additional head attachment portion is not provided between the head attachment portion 111A and the head attachment portion 211A.

In FIG. 10, m8 to m11 are distances estimated in the same manner as in FIG. 5 when three virtual heads (shown by dotted lines) corresponding to the additional heads 300 are virtually disposed between the head 101A and the head 201A so as to be arranged in a row in the sub-scanning direction. It is defined that Ld=m8+m9+m10+m11. In FIG. 10, it is assumed that the three virtual heads corresponding to the additional heads 300, the head 101A and the head 201A are arranged in a straight line in the sub-scanning direction and that the nozzle arrays thereof are also arranged in a straight line in the sub-scanning direction. In FIG. 10, M indicates the bleeding inhibition distance of the head 101A or the head 201A with respect to the virtual heads corresponding to the additional heads 300. M is calculated using the same mathematical expression as that used to calculate L to be described later. Magnitude correlations between Ld, m8 to m11, and M are m8≥M, m9≥M, m10≥M, m11≥M and Ld=m8+m9+m10+m11≥4M. Therefore, as shown in FIG. 10, even if the three virtual heads corresponding to the additional heads 300 are disposed between the head 101A and the head 201A so as to be arranged in a row in the sub-scanning direction, the bleeding relating to the ink of the virtual heads corresponding to the additional heads 300 is inhibited.

The head attachment portion 111B and the head attachment portion 211B are provided from the rear side toward the front side, to the right of the head attachment portion 111A and the head attachment portion 211A. The additional head attachment portion is not provided between the head attachment portion 111B and the head attachment portion 211B. The head attachment portion 111B is provided so as to be displaced forward from the head attachment portion 111A by a predetermined length. The head attachment portion 211B is also provided so as to be displaced forward from the head attachment portion 211A by a predetermined length. The head attachment portion 111C and the head attachment portion 211C are provided on the carriage 20E from the rear side toward the front side, to the right of the head attachment portion 111B and the head attachment portion 211B. The additional head attachment portion is not provided between the head attachment portion 111C and the head attachment portion 211C. The head attachment portion 111C is provided so as to be displaced forward from the head attachment portion 111B by a predetermined length. The head attachment portion 211C is also provided so as to be displaced forward from the head attachment portion 211B by a predetermined length.

A head attachment portion 111D and a head attachment portion 211D are provided from the rear side toward the front side, to the right of the head attachment portion 111C and the head attachment portion 211C. The additional head attachment portion is not provided between the head attachment portion 111D and the head attachment portion 211D. The head attachment portion 111D is provided so as to be displaced forward from the head attachment portion 111C by a predetermined length. The head attachment portion 211D is also provided so as to be displaced forward from the head attachment portion 211C by a predetermined length. The head attachment portions 111B, 111C and 111D, and the head attachment portions 211B, 211C and 211D respectively have the same structures as those of the head attachment portion 111A and the head attachment portion 211A. Examples of the first heads that are attached to the head attachment portions 111A to 111D are the white ink head 101A to a white ink head 101D. Further, examples of the second heads that are attached to the head attachment portions 211A to 211D are the color printing head 201A to a color printing head 201D.

Structure of Maintenance Unit 145A

Figure 11:
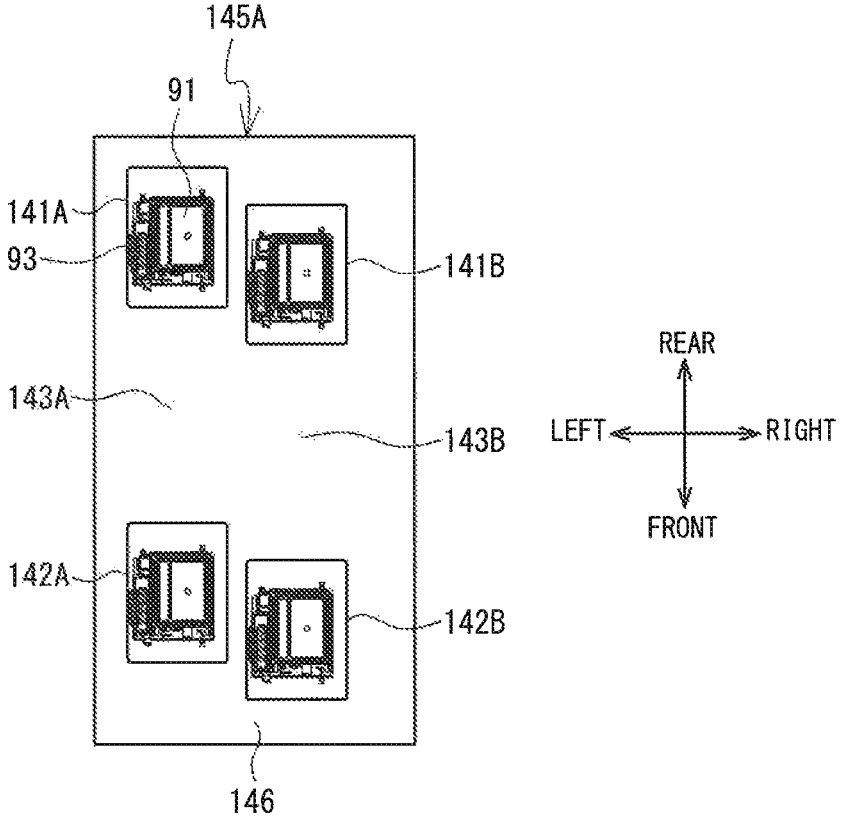
FIG. 11 is a plan view of a maintenance unit 145A.

The maintenance unit 145A, which corresponds to the carriage 20B of the second working example of the carriage 20, will be explained with reference to FIG. 11. The maintenance unit 145A is a unit that corresponds to the carriage 20B shown in FIG. 6. The maintenance unit 145A is provided in the non-printing area 140 shown in FIG. 3. The maintenance unit 145A includes a maintenance portion 141A and a maintenance portion 142A that are arranged on a base 146 having a rectangular shape in a plan view. The maintenance portion 141A is provided on the left side and on the rear side of the base 146, and the maintenance portion 142A is provided on the left side and on the front side of the base 146. An open space 143A is provided between the maintenance portion 141A and the maintenance portion 142A. Maintenance portions 141B and 142B are provided to the right of the maintenance portions 141A and 142A. An open space 143B is provided between the maintenance portion 141B and the maintenance portion 142B. The maintenance portions 141B and 142B are respectively provided so as to be displaced forward from the maintenance portions 141A and 142A by a predetermined length. The maintenance portions 141A, 142A, 141B and 142B each have the same structure as that of the maintenance portion 141 shown in FIG. 3.

Structure of Maintenance Unit 145B

Figure 12:
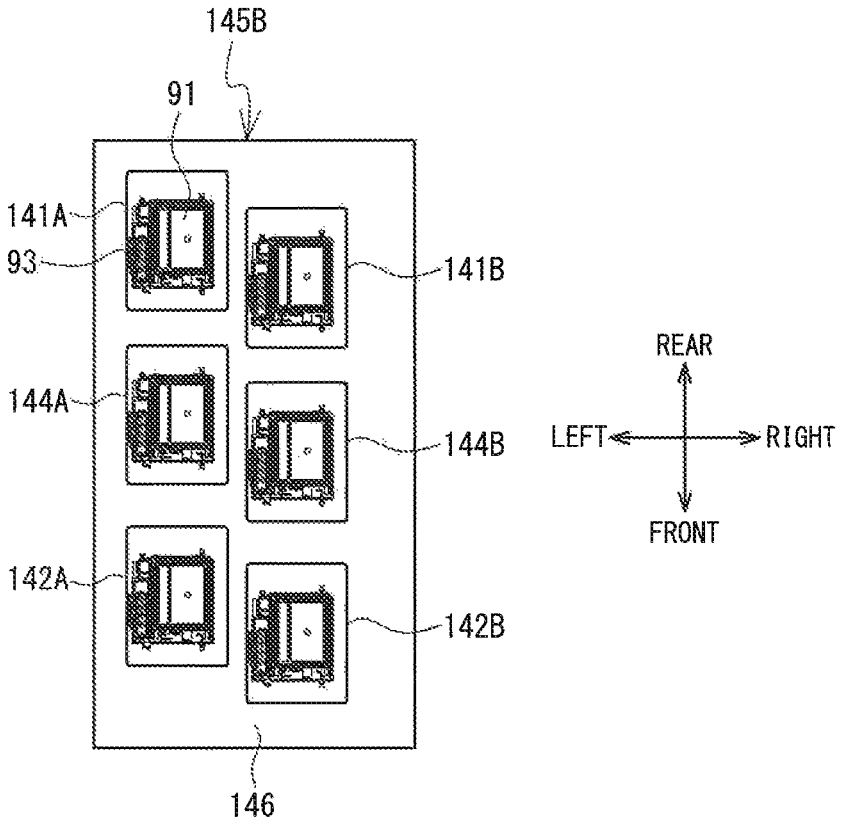
FIG. 12 is a plan view of a maintenance unit 145B.

The maintenance unit 145B, which corresponds to the carriage 20B of the second working example of the carriage 20, will be explained with reference to FIG. 12. The maintenance unit 145B is a unit that corresponds to the carriage 20B shown in FIG. 7. The maintenance unit 145B is provided in the non-printing area 140 shown in FIG. 3. The maintenance unit 145B includes the maintenance portion 141A, a maintenance portion 144A and the maintenance portion 142A that are provided from the rear side toward the front side, on the left side of the base 146 having a rectangular shape in a plan view. The maintenance portion 141B, a maintenance portion 144B and the maintenance portion 142B are provided to the right of the maintenance portions 141A, 144A and 142A, from the rear side toward the front side. The maintenance portions 141B, 144B and 142B are respectively provided so as to be displaced forward from the maintenance portions 141A, 144A and 142A by a predetermined length. The maintenance portions 141A, 144A, 142A, 141B, 144B and 142B each have the same structure as that of the maintenance portion 141 shown in FIG. 3. Since the number of the heads is increased, the maintenance portions 144A and 144B are additionally provided in the open space 143 shown in FIG. 3.

Structure of Ink Flow Path 70A

Figure 13:
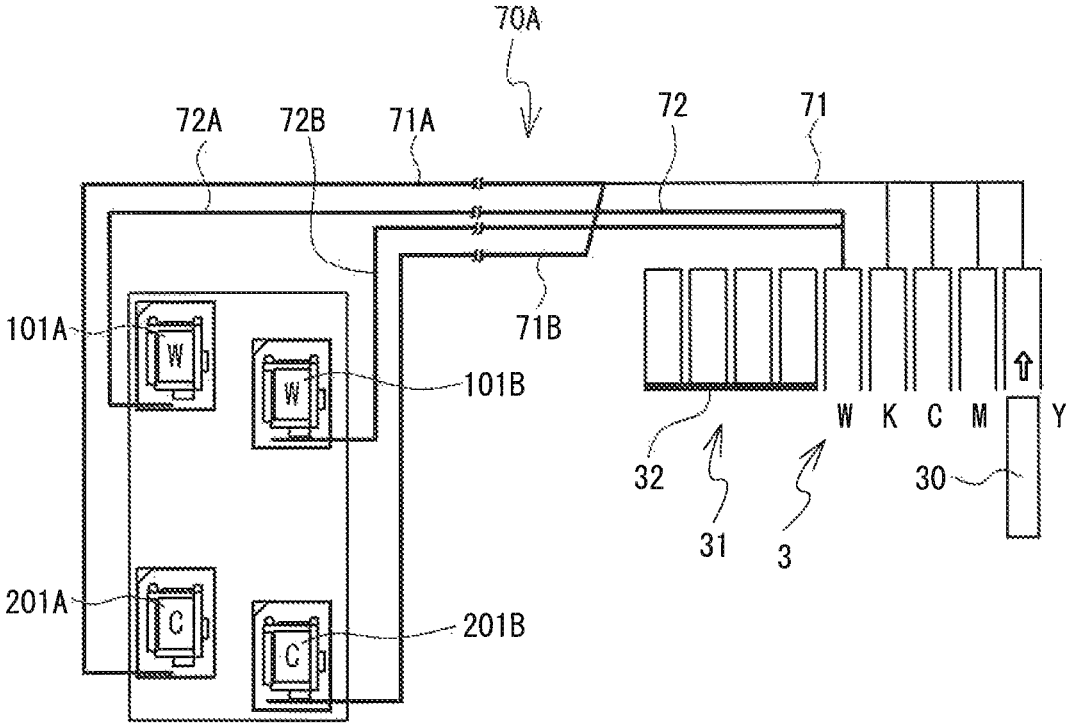
FIG. 13 is a diagram of an ink flow path 70A.

The structure of the ink flow path 70A that supplies the ink from the cartridges 30 to the heads will be explained with reference to FIG. 13. The ink flow path 70A is a flow path that corresponds to the carriage 20B shown in FIG. 6. The cartridges 30 for Y, M, C, K and W are mounted in the mounting portion 3. A storage portion 31, which is an unused section of the mounting portion 3, is provided with a lid 32. One end portion of a tube 71 is connected to each of the cartridges 30 for Y, M, C and K. In FIG. 13, the tube 71 is illustrated such that tubes for each color of Y, M, C and K are bundled together. The tube 71 branches into tubes 71A and 71B partway along the tube 71. The other end portion of the tube 71A is connected to the color printing head 201A, and the other end portion of the tube 71B is connected to the color printing head 201B. One end portion of a tube 72 is connected to the cartridge 30 for W. The tube 72 branches into tubes 72A and 72B partway along the tube 72. The other end portion of the tube 72A is connected to the white ink head 101A, and the other end portion of the tube 72B is connected to the white ink head 101B.

Structure of Ink Flow Path 70B

Figure 14:
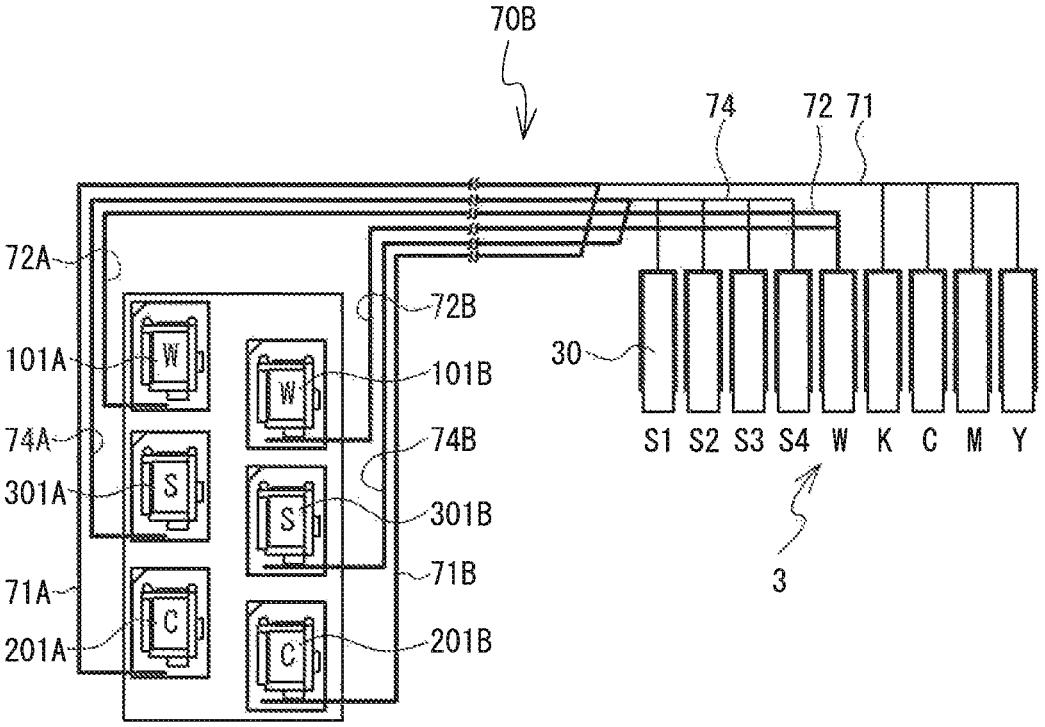
FIG. 14 is a diagram of an ink flow path 70B.

The structure of the ink flow path 70B will be explained with reference to FIG. 14. The ink flow path 70B is a flow path that corresponds to the carriage 20B shown in FIG. 7. The cartridges 30 (not shown in the drawings) for Y, M, C, K and W, and the cartridges 30 (not shown in the drawings) for special inks S1, S2, S3 and S4 are mounted in the mounting portion 3. The special inks S1, S2, S3 and S4 may be the same color or different colors. The tubes 71 and 72 are the same as those of the ink flow path 70A. One end portion of a tube 74 is connected to each of the cartridges 30 (not shown in the drawings) for the special inks S1 to S4. In FIG. 14, the tube 74 is illustrated such that tubes for the special inks S1 to S4 are bundled together. The tube 74 branches into tubes 74A and 74B partway along the tube 74. The other end portion of the tube 74A is connected to the special ink head 301A, and the other end portion of the tube 74B is connected to the special ink head 301B. The tube 74 is configured to correspond to the special inks S1 to S4 and the four cartridges 30. With respect to the tube 74, one to a maximum of four of the cartridges 30 for the special inks S1 to S4 may be selectively used corresponding to print content or color of the special inks S1 to S4. A plurality of the cartridges 30 for the special inks S1 to S4 of the same color may be mounted, and the special inks S1 to S4 may be supplied from the plurality of cartridges 30 to a single one of the special ink heads 301A and 301B, simultaneously or in a switching manner. In this case, flow paths for the special inks S1 to S4 of the unused tube 74 are provided with check valves (not shown in the drawings) so as not to affect the tube 74 that is being used.

In FIG. 14, the tube 74 of the ink flow path 70B is connected to the cartridges 30 for the special inks S1 to S4 and to the special ink heads 301A and 301B. However, the tube 74 may be connected to the cartridge 30 (not shown in the drawings) for the discharge printing ink (D) and to the discharge printing ink heads 302A and 302B.

Distance L Between Leading Nozzles that Does Not Cause Bleeding

Hereinafter, the distance L between the leading nozzles that does not cause bleeding will be explained with reference to FIG. 5. Tpw is a time period required until the leading nozzles on the rear end side of the second head (the color printing head 200 (C)) print a section that has been printed by the leading nozzles (not shown in the drawings) on the rear end side of the first head (the base printing head 100 (W)) of the carriage 20A that is the first working example shown in FIG. 5. During the time period required until the leading nozzles on the rear end side of the second head print the section that has been printed by the leading nozzles on the rear end side of the first head, the feeding of the platen 5 in the front-rear direction is repeated by a distance from the rear end side of the first head to the rear end side of the second head, while inserting a wait time after the movement in the main scanning direction. Accordingly, the following terms are defined.

L: Distance between leading nozzles, namely, the distance between the leading nozzles (not shown in the drawings) on the rear end side of the first head (the base printing head 100 (W)) and the leading nozzles on the rear end side of the second head (the color printing head 200 (C))

Tpw: Time period required until the leading nozzles of the second head print the section that has been printed by the leading nozzles of the first head Tcr: Total time of main scanning Tw: Wait time Cw: Platen feed number Ln: Nozzle array length in sub-scanning direction In: Interlace number In this case, the time period Tpw can be expressed as follows.

Tpw=(Total time of main scanning (Tcr)+Wait time (Tw))×(Distance (L) between leading nozzles/Nozzle length (Ln))×Interlace number (In)

Accordingly, Tpw=(Tcr+Tw)×Cw=(Tcr+Tw)×(L/Ln)×In, and the distance L can be expressed as follows.

$$L=(Tpw\times Ln)/((Tcr+Tw)\times In) \quad \text{Expression 1}$$

When the time period that does not cause the bleeding is calculated in advance on the basis of changes over time after the ejection of the ink, and the calculated time period is applied to Tpw, it is desirable that the distance L that does not cause the bleeding be:

$$L\geq(Tpw\times Ln)/((Tcr+Tw)\times In) \quad \text{Expression 2}$$

For example, if it can be seen that the ink dries up during 20 seconds on the basis of the changes over time after the ejection of the ink, it is sufficient that 20 seconds be substituted into Tpw in Expression 2 and the distance between the leading nozzles be set to a distance equal to or greater than the calculated distance L. The distance equal to or greater than the distance L is the bleeding inhibition distance M.

Ink Amount Setting Processing

Ink amount setting processing will be explained with reference to FIG. 15. The CPU 40 is connected to the operation portion 47 or to the printer 1. Therefore, when a command to set the ink amount is received from a terminal device, such as a PC (yes at step S11), the CPU 40 detects the type of the additional head (step S12). When the CPU 40 determines that the command to set the ink amount has not been received (no at step S11), the CPU 40 returns the processing to step S11. The CPU 40 detects the type of the additional head 300 attached to the additional head attachment portion 310 detected by the head sensor 34 (step S12). When the CPU 40 detects the discharge printing ink head 302 (yes at step S13), the CPU 40 performs ink amount reduction processing (step S14). In the ink amount reduction processing, the CPU 40 stores, in the RAM 42, a flag that reduces the ink amount used in the white ink printing or the color printing, in comparison to when the additional head is not the discharge printing ink head 302. In the ink amount reduction processing (step S14), the CPU 40 causes the ejection amount of the ink used in the white ink printing or the color printing to be reduced by a predetermined amount, in comparison to when the discharge printing ink head 302 is not attached to the additional head attachment portion 310. When the discharge printing ink head 302 is not detected (no at step S13), the CPU 40 ends the ink amount setting processing.

Mode Setting Processing

Mode setting processing will be explained with reference to FIG. 16. When a command to perform the mode setting processing is received from the operation portion 47, or from the terminal device, such as the PC, connected to the printer 1 (yes at step S21), the CPU 40 determines whether a mode is a first printing mode (step S22). When the CPU 40 determines that the command to perform the mode setting processing has not been received (no at step S21), the CPU 40 returns the processing to step S21. When the CPU 40 determines that the command is the command for the first printing mode (yes at step S22), the CPU 40 stores a flag indicating the first printing mode in the RAM 42 (step S23). The first printing mode is a printing mode in which, when the ink ejected by the additional head 300 is the special ink, in the same main scan of the print medium, the printing is performed together using ink for base printing, the color ink, and the special ink. Further, when the CPU 40 determines that the command is not the command for the first printing mode (no at step S22), when the CPU 40 determines that the command is a command for a second printing mode (yes at step S24), the CPU 40 stores a flag indicating the second printing mode in the RAM 42 (step S25). The second printing mode is a mode in which the printing is performed together in the same scan using the color ink and the special ink, onto an area of the print medium that has been printed using the ink for the base printing. When the CPU 40 determines that the command is not the command for the first printing mode (no at step S22) and determines that the command is not the command for the second printing mode (no at step S24), the CPU 40 ends the mode setting processing.

Print Processing

Figure 17:
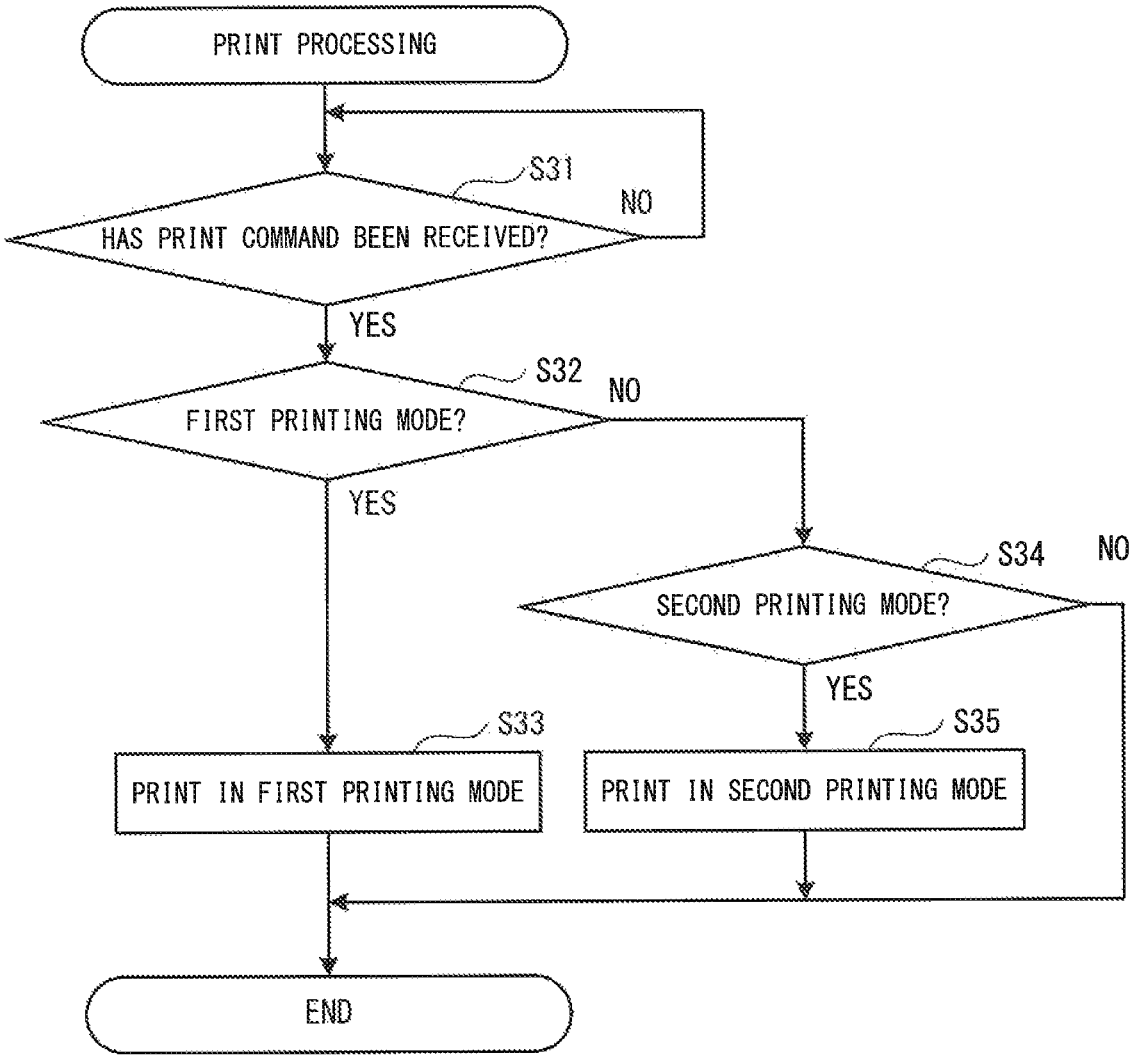
FIG. 17 is a flowchart of print processing.

Print processing will be explained with reference to FIG. 17. When a print processing command is received from the operation portion 47 or from the terminal device, such as the PC, that is connected to the printer 1 (yes at step S31), the CPU 40 determines whether the mode is the first printing mode (step S32). When the flag stored in the RAM 42 is the first printing mode flag, the CPU 40 determines that the mode is the first printing mode (yes at step S32), and performs the printing in the first printing mode (step S33). When the flag stored in the RAM 42 is not the first printing mode flag (no at step S32), and is the second printing mode flag (yes at step S34), the CPU 40 determines that the mode is the second printing mode (yes at step S34), and performs the printing in the second printing mode (step S35). Thus, using the mode setting processing, when the print medium is a material for which it is better to leave some time between performing the base printing and the printing using the color ink and the special ink, a user sets the second printing mode. Further, when the print medium is a material for which it is better to perform the base printing and the printing using the color ink and the special ink together in the same main scan, the user sets the first printing mode. Thus, in the print processing, the printing can be performed in the printing mode that suits the print medium. When the CPU 40 determines that the flag stored in the RAM 42 is not the second printing mode flag (no at step S34), the CPU 40 ends the processing. When the CPU 40 determines that the command for the print processing has not been received (no at step S31), the CPU 40 returns the processing to step S31.

Figure 19:
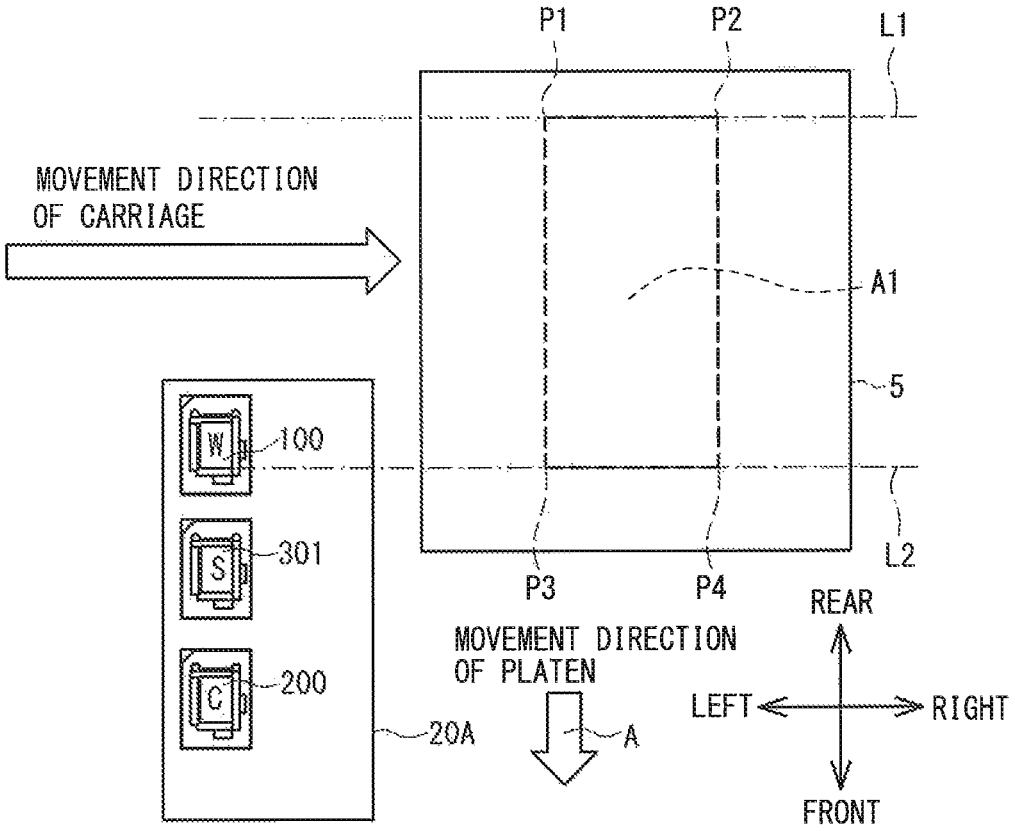
FIG. 19 is a diagram showing a positional relationship of a platen 5 and the carriage 20A that moves toward the platen 5 located at a base printing start position.

An example of the print processing performed in the first printing mode by the carriage 20A provided with the white ink head 100, the special ink head 301 as the additional head, and the color printing head 200 will be explained with reference to FIG. 19. A rectangular area A1 surrounded by positions P1, P2, P3, and P4 shown in FIG. 19 is an area in which the base printing is necessary. As shown in FIG. 19, the CPU 40 moves the platen 5 to a scanning position L2 including the position P3, which is a base printing start position of the head 100. Next, the CPU 40 causes the carriage 20A to reciprocate in the left-right direction from the position P3 with respect to the area A1 in which the base printing is necessary, and causes the white ink to be ejected from the nozzles 61 (refer to FIG. 18) of the head 100, thus starting the base printing. The CPU 40 sequentially moves the platen 5 forward (in the direction of an arrow A) while causing the carriage 20 to reciprocate in the left-right direction. Thus, the CPU 40 performs the base printing through bi-directional printing or uni-directional printing.

Next, when the front end of the nozzle array 62 (refer to FIG. 18) of the head 301 faces the position P3, the CPU 40 starts the ejection of the special ink from the head 301. When the CPU 40 sequentially moves the platen 5 forward (in the direction of the arrow A), and the front end of the nozzle array 62 (refer to FIG. 18) of the head 200 faces the position P3, the CPU 40 starts the ejection of the color ink from the head 200. Therefore, in the same scan (the same main scan) of the print medium, the CPU 40 performs the printing together on the print medium using the white ink for the base printing, the color ink, and the special ink.

Note that, in the above-described embodiment, if the ejection relating to the ink of the plurality of heads is simultaneous, the printing time is shorter than when the ejection is not simultaneous. The phrase "performs the printing together in the same scan" by the plurality of heads in the above-described embodiment is not referring to a case in which the plurality of heads eject the ink at the same time onto the same area. The area onto which the plurality of heads eject the ink is separate for each of the heads. "Performs the printing together in the same scan" refers to a case in which each of the heads ejects the ink onto respectively facing areas during the single scan (movement in the main scanning direction). In other words, a timing at which the plurality of heads eject the ink is preferably the same, but given restrictions of power supply and control, the timing may be shifted for each head. Note that, in the first printing mode, ink is not ejected simultaneously from each of the nozzles of the base printing head 100, the special ink head 301, and the color printing head 200 at all timings. For example, when all of the three heads 100, 200, and 301 are arranged above the print medium, the three heads 100, 200, and 301 may simultaneously eject the ink, and when one of the three heads 100, 200, and 301 is not arranged above the print medium, the head that is not arranged above the print medium does not eject the ink, and it is sufficient that the remaining heads eject the ink.

Next, when the ejection of the white ink is complete up to the position P1 or the position P2 by the head 100, the CPU 40 ends the ejection of the white ink from the head 100. When the ejection of the special ink is complete up to the position P1 or the position P2 by the head 301, the CPU 40 ends the ejection of the special ink from the head 301. When the ejection of the color ink is completed up to the position P1 or the position P2 by the head 200, the CPU 40 ends the ejection of the color ink from the head 200.

Figure 20:
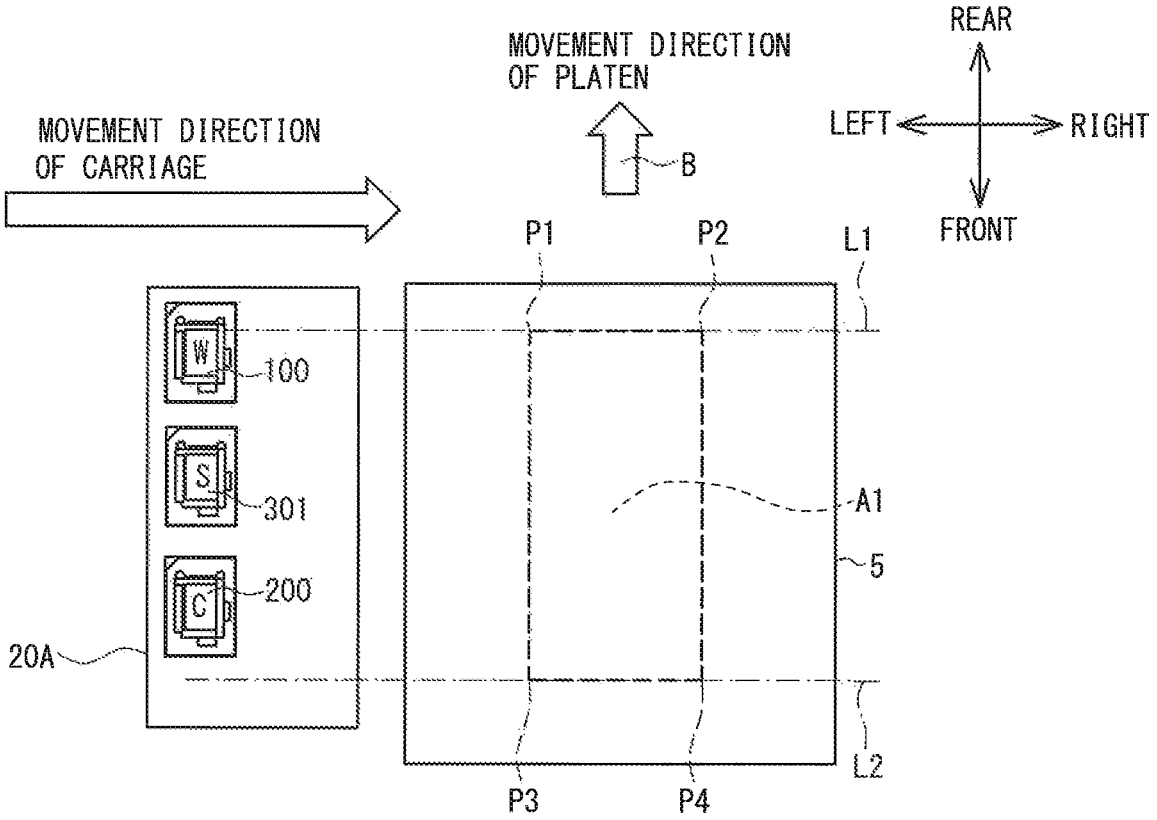
FIG. 20 is a diagram showing a positional relationship of the platen 5 and the carriage 20A that moves toward the platen 5 located at the base printing start position.

Next, an example of the print processing performed in the second printing mode by the carriage 20A provided with the head 100, the head 301, and the head 200 will be explained with reference to FIG. 20 and FIG. 21. For example, as shown in FIG. 20, the CPU 40 performs the base printing on the area A1 when the platen 5 is conveyed from the front side to the rear side (a direction of an arrow B). When the rear end of the nozzle array 62 (refer to FIG. 18) of the head 100 faces the position P1, the CPU 40 starts the ejection of the white ink from the head 100. Next, when the ejection of the white ink by the head 100 is complete up to the position P3 or the position P4, the CPU 40 ends the ejection of the white ink from the head 100.

Figure 21:
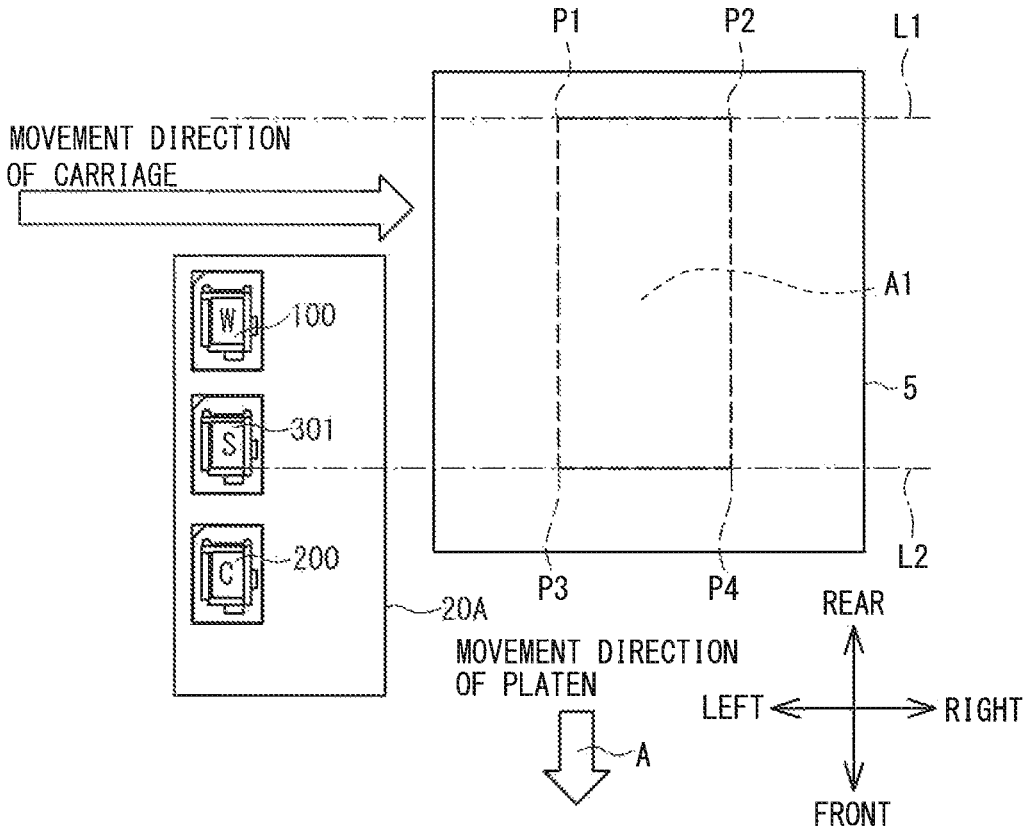
FIG. 21 is a diagram showing a positional relationship of the platen 5 and the carriage 20A that moves toward the platen 5 located at a printing start position when a characteristic ink is used.

Next, as shown in FIG. 21, the CPU 40 moves the platen 5 from the rear side toward the front side (in the direction of the arrow A) with respect to the area A1 on which the base printing is complete. When the front end of the nozzle array 62 (refer to FIG. 18) of the head 301 faces the position P3, the CPU 40 starts the ejection of the special ink from the head 301. When the front end of the nozzle array 62 (refer to FIG. 18) of the head 200 faces the position P3, the CPU 40 starts the ejection of the color ink from the head 200. Therefore, in the same scan of the print medium, the CPU 40 performs the printing together using the color ink and the special ink. When the ejection of the special ink by the head 301 is complete up to the position P1 or the position P2, the CPU 40 ends the ejection of the special ink from the head 301. When the ejection of the color ink by the head 200 is complete up to the position P1 or the position P2, the CPU 40 ends the ejection of the color ink from the head 200.

Figure 22:
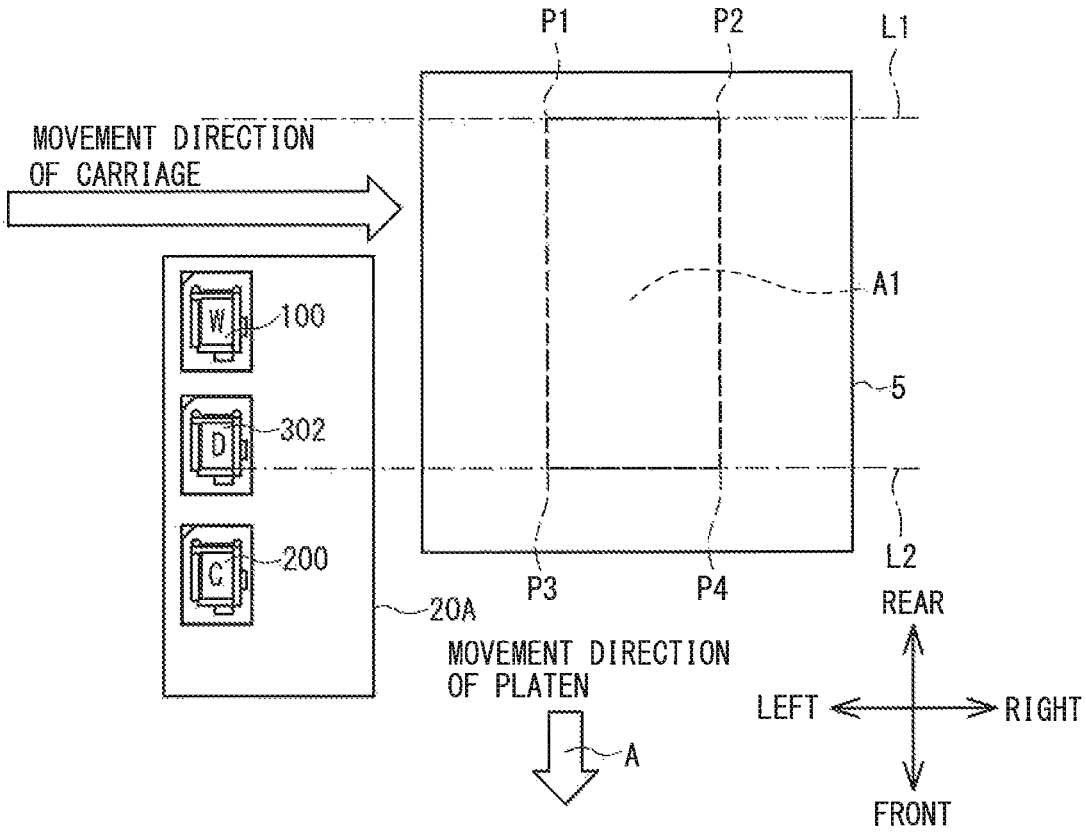
FIG. 22 is a diagram showing a positional relationship of the platen 5 and the carriage 20A that moves toward the platen 5 located at a discharge printing start position.

Next, the print processing when the additional head 300 is the discharge printing ink head 302 will be explained with reference to FIG. 22. As shown in FIG. 22, the CPU 40 moves the platen 5 to the scanning position L2 including the position P3, which is a discharge printing start position of the head 302. Next, the CPU 40 causes the carriage 20A to move to the right, and causes the discharge printing ink to be ejected from the nozzles 61 (refer to FIG. 18) of the head 302 onto the area A1 in which the discharge printing is necessary, thus starting the discharge printing. The CPU 40 sequentially moves the platen 5 forward (in the direction of the arrow A) while causing the carriage 20A to reciprocate in the left-right direction. Thus, the CPU 40 performs the discharge printing using the head 302.

Next, when the rear end of the nozzle array 62 (refer to FIG. 18) of the head 200 faces the position P3, the CPU 40 starts the ejection of the color ink from the head 200. Thus, at the same time as ejecting the discharge printing ink using the head 302 onto an area below the head 302, the CPU 40 ejects the color ink using the head 200 onto an area below the head 200. As a result, in the same scan of the print medium, the CPU 40 performs the printing together using the discharge printing ink and the color ink. In other words, a discharge printing area and a color printing area that are mutually separated in the sub-scanning direction are formed together in the same scan. When the ejection of the discharge printing ink by the head 302 is complete up to the position P1 or the position P2, the CPU 40 ends the ejection of the discharge printing ink from the head 302. When the ejection of the color ink by the head 200 is complete up to the position P1 or the position P2, the CPU 40 ends the ejection of the color ink from the head 200.

Figure 23:
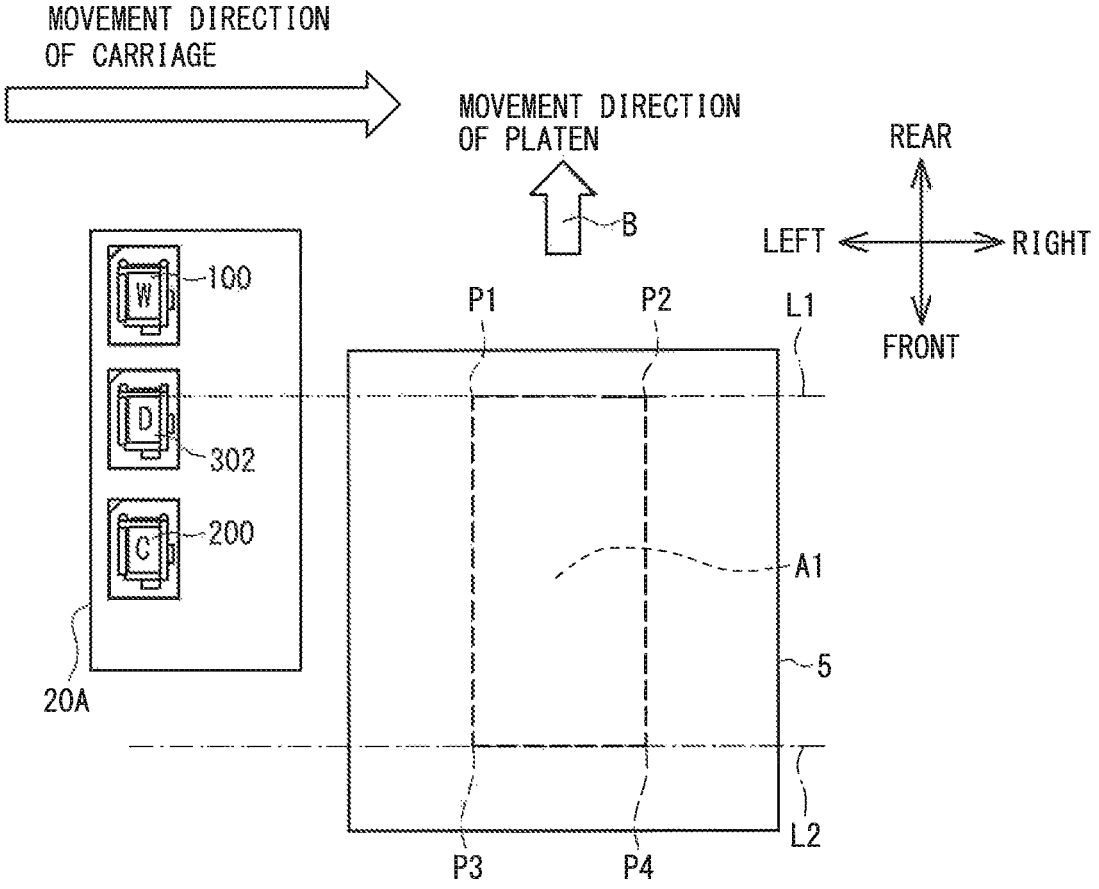
FIG. 23 is a diagram showing a positional relationship of the platen 5 and the carriage 20A that moves toward the platen 5 located at the discharge printing start position.

Next, the print processing when the additional head 300 is the discharge printing ink head 302 will be explained with reference to FIG. 23 to FIG. 25. As shown in FIG. 23, after the CPU 40 moves the platen 5 to a scanning position L1 including the position P1, which is the discharge printing start position of the head 302, the CPU 40 causes the carriage 20A to move to the right, and thereafter causes the discharge printing ink to be ejected from the nozzles 61 (refer to FIG. 18) of the head 302 onto the area A1 in which the discharge printing is necessary, thus starting the discharge printing. Thus, the CPU 40 performs the discharge printing by moving the platen 5 from the front side to the rear side. The CPU 40 sequentially moves the platen 5 rearward (in the direction of the arrow B) while causing the carriage 20A to reciprocate in the left-right direction, and thus performs the discharge printing using the head 302. As shown in FIG. 23, when the ejection of the discharge printing ink is complete up to the position P3 or the position P4, the CPU 40 ends the ejection of the discharge printing ink from the head 302.

Next, when the base printing using the white ink is necessary between the discharge printing and the color printing, the CPU 40 moves the platen 5 in the direction of the arrow B (rearward) in FIG. 23. Next, the CPU 40 causes the carriage 20A to move to the right from a state shown in FIG. 24, and moves the platen 5 such that the front end of the nozzle arrays 62 (refer to FIG. 18) of the head 100 is aligned with the scanning position L2 including the position P3. After that, when the CPU 40 causes the carriage 20A to the right in accordance with the base printing, the CPU 40 starts the base printing by the head 100 on the area A1 of the print medium on which the discharge printing has been performed using the discharge printing ink. The CPU 40 sequentially moves the platen 5 forward (in the direction of the arrow A) while causing the carriage 20 to reciprocate in the left-right direction, and thus performs the base printing by the head 100.

Next, in a state in which the platen 5 has been moved such that the front end of the nozzle arrays 62 (refer to FIG. 18) of the head 200 is aligned with the scanning position L2 including the position P3, the CPU 40 is ejecting the white ink, using the head 100, onto the area below the head 100. Thus, the CPU 40 ejects the color ink, using the head 200, onto the area below the head 200. In other words, a base printing area and a color printing area, which are separated from each other in the sub-scanning direction, are formed together in the same scan. As shown in FIG. 25, when the ejection of the white ink is complete up to the position P1 or the position P2, the CPU 40 ends the ejection of the white ink from the head 100. When the ejection of the color ink is complete up to the position P1 or the position P2, the CPU 40 ends the ejection of the color ink from the head 200. In order to remove the printed print medium, the CPU 40 moves the platen 5 forward (in the direction of the arrow A) and moves the carriage 20A to a stand-by position.

Operations and Effects of Printer 1 of Embodiment

In the printer 1 of the present disclosure, the head 100 and the head 200 are mounted on the carriage 20A so as to be separated from each other in the sub-scanning direction. On the carriage 20A, the additional head attachment portion 310, to which the additional head 300 can be added, is provided between the head 100 and the head 200. The additional head 300 is the special ink head 301, or is the discharge printing ink head. Thus, the additional head 300 can be selectively attached to the additional head attachment portion 310 and the printer 1 can correspond to a variety of printing.

Further, in the printer 1, at least one of the maintenance portions 144A and 144B that perform the maintenance of the additional head 300 attached to the additional head attachment portion 310, and the ink flow path 70B that supplies the ink to the additional head 300 can be additionally provided. Thus, the maintenance of or the supply of the ink to the additional head 300 can be performed.

Further, when the main scanning drive portion 44 moves the carriage 20A in the main scanning direction and performs one scan, the CPU 40 performs the first printing mode in which the ink is ejected from each of the head 100, the head 200, and the additional head 300 and printing is performed. Therefore, in the same scan of the print medium, the printing can be performed together using the white ink for base printing, the color ink, and the special ink. As a result, a printing time can be shortened in contrast to a case in which the printing is performed in each of scans sequentially using the ink for the base printing, the color ink and the special ink.

Further, when the sub-scanning drive portion 45 moves at least one of the print medium and the carriage 20A to one side in the sub-scanning direction and the main scanning drive portion 44 moves the carriage 20A in the main scanning direction and performs the one scan, the CPU 40 causes the ink to be ejected from at least one head of the head 100, the head 200, and the additional head 300. For example, the CPU 40 causes the white ink to be ejected from the head 100. Next, when the sub-scanning drive portion 45 moves at least one of the print medium and the carriage 20A to the other side in the sub-scanning direction, and the main scanning drive portion 44 transports the carriage 20A in the main scanning direction and performs the one scan, the CPU 40 performs the second printing mode in which the ink is ejected from the remaining heads of the head 100, the head 200, and the additional head 300 and the printing is performed. For example, the CPU 40 causes the color ink and the special ink to be ejected from the head 200 and the additional head 300, respectively. Thus, for example, when the ink ejected by the additional head 300 is the special ink, it is possible to perform the printing together in the same scan using the color ink and the special ink, on the area of the print medium that has already been printed using the ink for the base printing, as in the second printing mode. As a result, the printing time can be shortened in contrast to the case in which the printing is performed in each of scans sequentially using the ink for the base printing, the color ink and the special ink.

Figure 16:
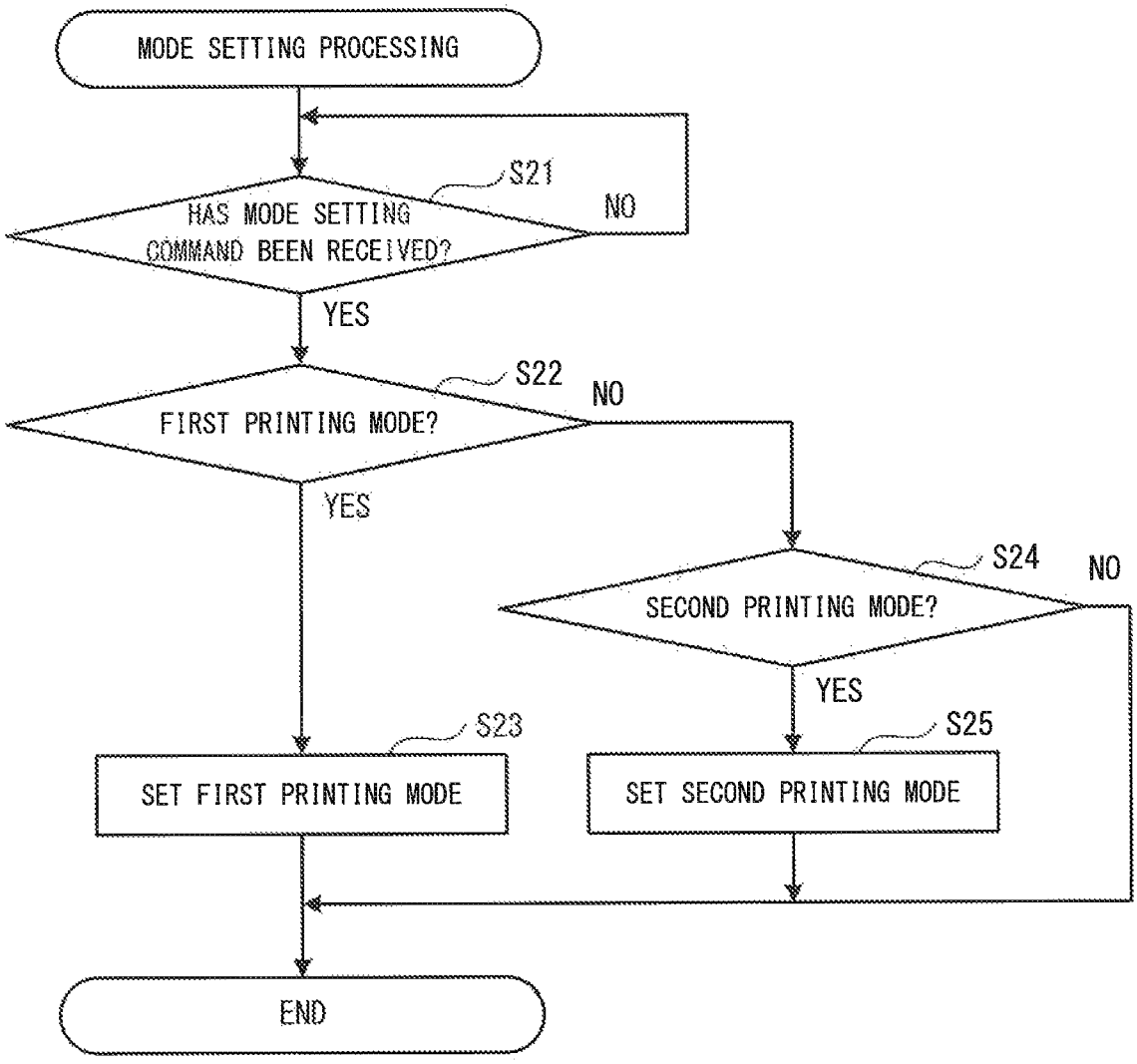
FIG. 16 is a flowchart of mode setting processing.

Further, by adopting the configuration in which the CPU 40 can set the plurality of printing modes using the mode setting processing shown in FIG. 16, an operator can set the printing mode suited to the print medium.

In addition, when the ink ejected by the additional head 300 is the discharge printing ink, after causing the discharge printing start position of the additional head 300 to be the start position of the color printing by the color printing head 200, the CPU 40 performs the color printing, using the head 200, onto the area of the print medium on which the discharge printing has been performed using the discharge printing ink. Thus, the color printing by the head 200 can be performed on the area of the print medium on which the discharge printing has been performed using the discharge printing ink. In this case, in comparison to a case in which the discharge printing and the color printing are performed using separate devices, it is possible to perform the color printing on the area of the print medium on which the discharge printing has been performed, without any displacement.

Further, when the ink ejected by the additional head 300 is the discharge printing ink for the base printing, the CPU 40 performs the printing on the print medium using the white ink from the head 100 and the color printing using the color ink from the head 200 onto the area of the print medium on which the discharge printing has been performed using the discharge printing ink. In this case, the printing on the print medium using the white ink, and the color printing using the color ink can be performed on the area of the print medium on which the discharge printing has been performed using the discharge printing ink. In this case, in comparison to a case in which the printing using the white ink and the color printing are performed by a device separate from the device that ejects the discharge printing ink, it is possible to perform the color printing on the area of the print medium on which the base printing has been performed using the white ink, without any displacement.

Figure 15:
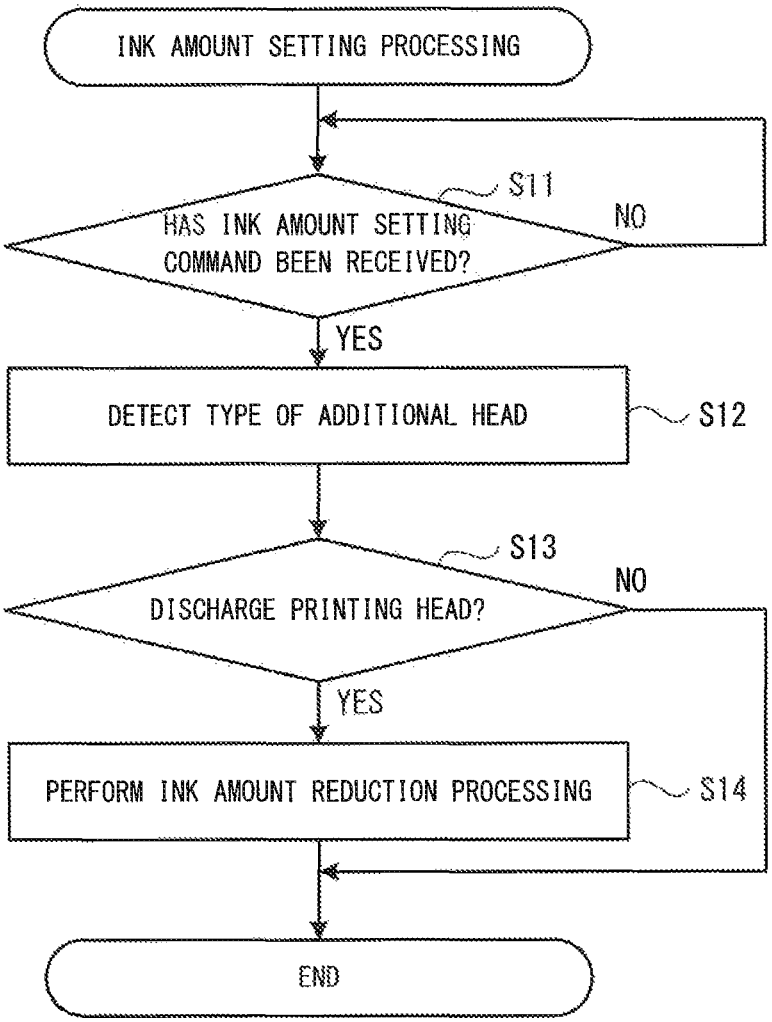
FIG. 15 is a flowchart of ink amount setting processing.

Further, in the ink amount setting processing shown in FIG. 15, when the ink ejected by the additional head 300 is the discharge printing ink (yes at step S13), the CPU 40 performs the ink amount reduction processing (step S14), which performs control to reduce the ink amount ejected by at least one of the color printing head 200 and the base printing head. In this case, when the ink ejected by the additional head is the discharge printing ink, it is possible to save an ink amount ejected from at least one of the color printing head and the base printing head. In other words, a material from which pigment, color, dye and the like of the material has been decolored by a discharge printing agent, becomes white, and when filling using the white ink, the amount of the white ink can be reduced.

In the printer 1 of the present disclosure, the head 100 and the head 200 are disposed on the carriage 20 such that the head 100 and the head 200 are separated from each other in the sub-scanning direction by equal to or greater than the length, in the sub-scanning direction, of one of the head 100 and the head 200 for which the length Ln (refer to FIG. 18) of the nozzle array in the sub-scanning direction is shorter. In this case, at a time of printing, the CPU 40 moves the head 100 and the head 200 relative to the print medium such that, after the print medium faces the head 100, the print medium faces a section of separation between the head 100 and the head 200, and, further, faces the head 200. Thus, a section of the white ink ejected onto the print medium from the head 100 is caused to face the section of separation between the head 100 and the head 200 before facing the head 200. As a result, between the ejection of the head 100 and the ejection of the head 200, it is not necessary to provide a wait time in order to inhibit the bleeding of the ink, and the printing time can be shortened in contrast to a case in which the wait time is newly provided.

Further, between the ejection of the ink for the base printing by the first head 100 and the ejection of the ink from the second head 200 onto an area on which the ink for the base printing has been ejected, it is not necessary to provide the wait time in order to inhibit the bleeding of the ink, and the printing time can be shortened in contrast to the case in which the wait time is provided.

In addition, in the printer 1, when a distance of separation between the head 100 and the head 200 satisfies $L \geq (Tpw \times Ln)/((Tcr+Tw) \times In)$, between the ejection by the head 100 and the ejection by the head 200, it is not necessary to provide the wait time in order to inhibit the bleeding of the ink, and the printing time can be shortened in contrast to the case in which the wait time is newly provided in order to inhibit the bleeding of the ink. Until the ink is ejected from the nozzle arrays 62 (refer to FIG. 18) of the head 200 onto a section on which the ink has been ejected from the nozzle arrays 62 (refer to FIG. 18) of the head 100, the time period Tpw elapses. Thus, if the drying time of the ink ejected from the nozzle arrays 62 of the head 100 is Tpw, the distance of separation L between the head 100 and the head 200 in order that the bleeding does not occur becomes evident. As a result, if the distance of separation between the head 100 and the head 200 is equal to or greater than L, the head 200 ejects the ink in a state in which the ink ejected from the head 100 is dry, and thus, the bleeding of the ink is reduced.

The printer 1 is an example of a "liquid ejection device" of the present disclosure. The heads 100, and 101A to 101D are examples of a "first head" of the present disclosure. The heads 200, and 201A to 201D are examples of a "second head" of the present disclosure. The additional heads 300, 301A and 301B are examples of an "additional head" of the present disclosure. The CPU 40 is an example of a "control portion" of the present disclosure. The main scanning drive portion 44 is an example of a "movement mechanism" of the present disclosure.

The present disclosure is not limited to the above-described embodiment, and various modifications are possible. For example, in the ink amount setting processing, in place of the detection processing (step S12) of the type of the additional head, a type of the head mounted on the printer 1 may be input by the user from the operation portion 47, and the CPU 40 may automatically set a reduction amount of the ink on the basis of the input result. Further, the CPU 40 may perform automatic analysis of print data for printing in the printer 1, and the CPU 40 may automatically set the reduction amount of the ink on the basis of the analysis result. An example of the automatic analysis is a case in which the CPU 40 analyzes that, with respect to a whole area on which the additional head 300 ejects the ink, after the ejection of the liquid by the additional head 300, the liquid is ejected by the head other than the additional head 300. The CPU 40 may perform the automatic analysis on the basis of an ejection order of each of the heads and on overlap of printing positions. Further, in the printer 1, in accordance with the number and the type of the heads mounted on the carriage 20, drive control of a voltage, electric current, waveform, timing and the like to drive the carriage 20 may be changed as necessary. The changes to the drive control may be determined by an input operation by the user. In addition, the changes to the drive control may be automatically determined by automatically detecting the number and the type of the heads mounted on the carriage 20, or by automatically analyzing the number and the type of the heads from the image to be printed and processes.

Figure 24:
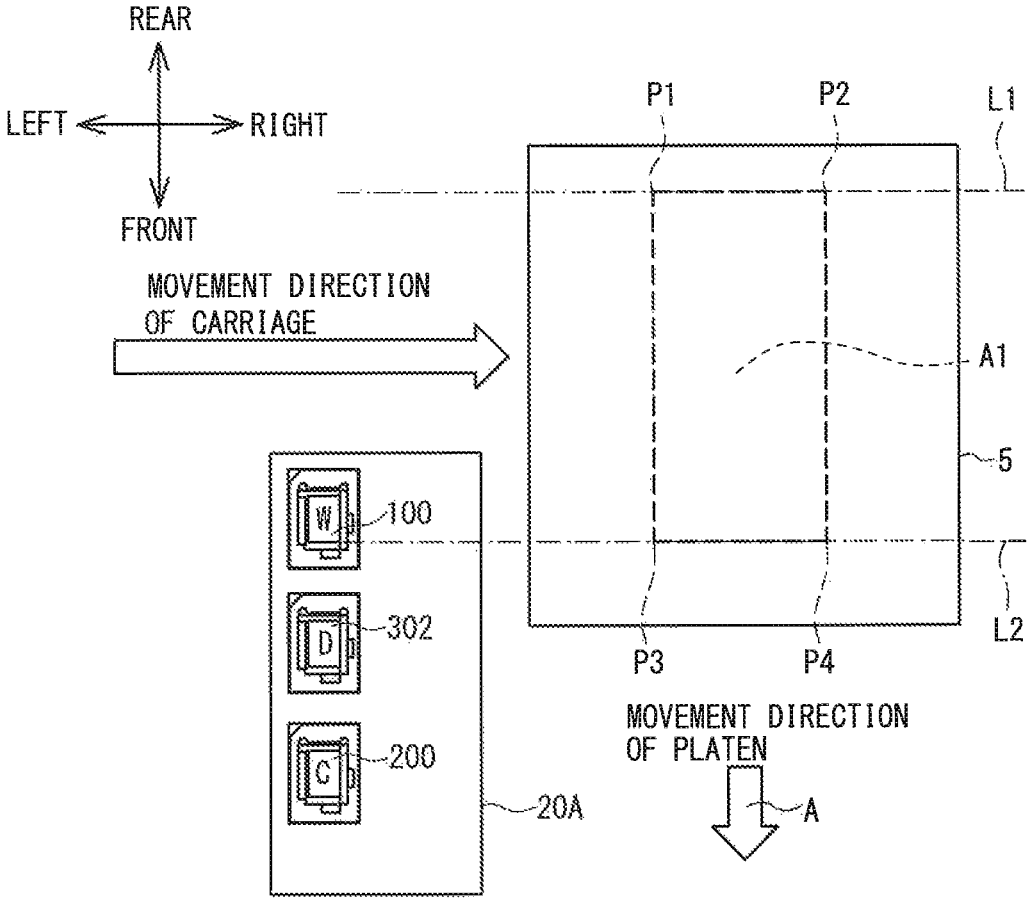
FIG. 24 is a diagram showing a positional relationship of the platen 5 and the carriage 20A that moves toward the platen 5 located at the base printing start position.
Figure 25:
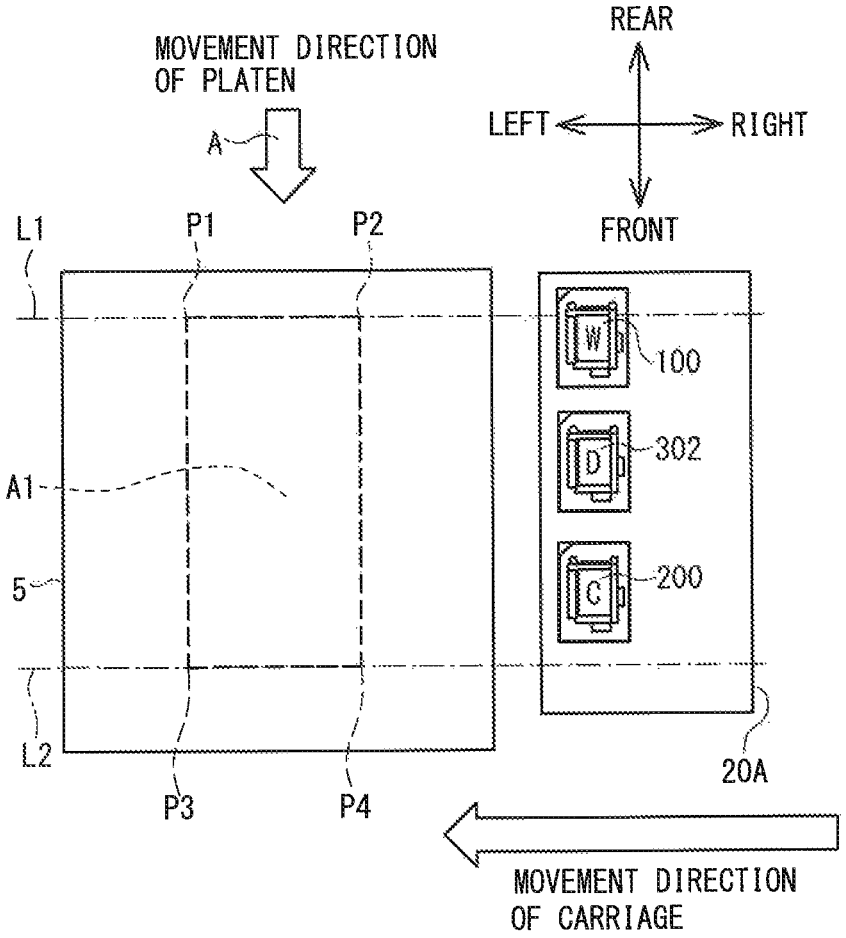
FIG. 25 is a diagram showing a positional relationship of the platen 5 and the carriage 20A that has passed the platen 5 located at a base printing complete position.

Further, the diagrams of FIG. 23 and FIG. 24 are shown in an order in which the CPU 40 performs the discharge printing using the head 302, and after that, performs the white ink printing using the head 100 and the color printing using the head 200. In the discharge printing using the head 302, the CPU 40 sequentially moves the platen 5 in the rearward direction (the direction of the arrow B) from the scanning position L1 (refer to FIG. 23) including the position P1, which is the discharge printing start position, while causing the carriage 20A to reciprocate in the left-right direction. The CPU 40 thus performs the discharge printing up to the scanning position L2 (refer to FIG. 23) including the position P4, which is a discharge printing complete position. Next, as shown in FIG. 24, the CPU 40 sequentially moves the platen 5 in the forward direction (the direction of the arrow A) until the front end of the nozzle arrays 62 (refer to FIG. 18) of the head 100 is aligned with the scanning position L2 including the position P3, which is the base printing start position. Next, the CPU 40 sequentially moves the platen 5 in the forward direction (the direction of the arrow A) while causing the carriage 20A to reciprocate in the left-right direction, and thus performs the base printing from the scanning position L2 using the head 100. As shown in FIG. 24, in a state in which the platen 5 has been moved such that the front end of the nozzle arrays 62 (refer to FIG. 18) of the head 200 is aligned with the scanning position L2, the white ink is being ejected onto the area A1. Next, the CPU 40 sequentially moves the platen 5 in the forward direction (the direction of the arrow A) while causing the carriage 20A to move to the right, and starts the color printing by ejecting the color ink from the head 200 onto the area A1, from the scanning position L2. The CPU 40 sequentially moves the platen 5 in the forward direction (the direction of the arrow A) while causing the carriage 20A to reciprocate in the left-right direction, and thus performs the color printing using the head 200 up to the scanning position L1. Thus, the CPU 40 starts the base printing from the scanning position L2 after the discharge printing, and, before the color printing, sequentially moves the platen 5 in the forward direction (the direction of the arrow A) until the front end of the nozzle arrays 62 (refer to FIG. 18) of the head 200 is aligned with the scanning position L2. The head 200 is separated in the sub-scanning direction from the head 100 due to the presence of the head 302. This is in order to secure the drying time of the discharge printing ink and the white ink, since the base printing is started from the front side. In addition, when the drying time of the discharge printing ink and the base printing ink is short, or when bleeding of the base printing ink due to the influence of the discharge printing ink is allowable, the CPU 40 moves the platen 5 once in the rearward direction after the discharge printing, by a short distance from a position at which the front end of the nozzle arrays 62 (refer to FIG. 18) of the discharge printing ink head 302 shown in FIG. 23 is aligned with the scanning position L2 to a position at which the front end of the nozzle arrays 62 (refer to FIG. 18) of the head 100 shown in FIG. 24 is aligned with the scanning position L2. It is thus possible to secure the drying time of the discharge printing ink. Before the base printing after the discharge printing, the platen 5 that has already passed the head 100 and is positioned to the rear may be moved in the opposite direction to the arrow B shown in FIG. 23, from the scanning position L1 including the position P1 to the scanning position of the printing start position of the head 100. In this case, a longer drying time can be secured for the discharge printing ink and the base printing ink with respect to the color ink. Next, the base printing may be performed up to the discharge printing complete position P4 while moving the platen 5 from the front side to the rear side. Next, the platen 5 may be moved from the scanning position L1 including the discharge printing start position P1 to the scanning position of the printing start position of the color printing head 200, and then, the color printing may be performed up to the discharge printing complete position P4 while moving the platen 5 from the front side to the rear side.

In the above-described printing processes, when the carriage 20A moves from the left to the right, the printing is started with respect to the area A1, and thus, the start position of the discharge printing, the base printing, and the color printing (the position P1) is located on the left end side of the area A1. If the printing is started with respect to the area A1 when the carriage 20A moves from the right to the left, the start position of the discharge printing, the base printing, and the color printing (the position P2) is located on the right end side of the area A1. All of the start positions of the discharge printing, the base printing, and the color printing are located on either the left end side or the right end side of the area A1, but the start position of any one of the discharge printing, the base printing, and the color printing may be located on the other side.

In the above-described printing processes, when the platen 5 moves from the rear to the front, when the printing is started with respect to the area A1 on which the printing is required, the start position of the discharge printing, the base printing, and the color printing is located at the rear side of the area A1. If the printing is started with respect to the area A1 when the platen 5 moves from the front to the rear, the start position of the discharge printing, the base printing, and the color printing may be located on the front side of the area A1. Further, the start positions of the discharge printing, the base printing, and the color printing are not limited to all being located on the rear side or the front side of the area A1, and the start position of any one of the discharge printing, the base printing, and the color printing may be located on the other side.

Figure 29A:
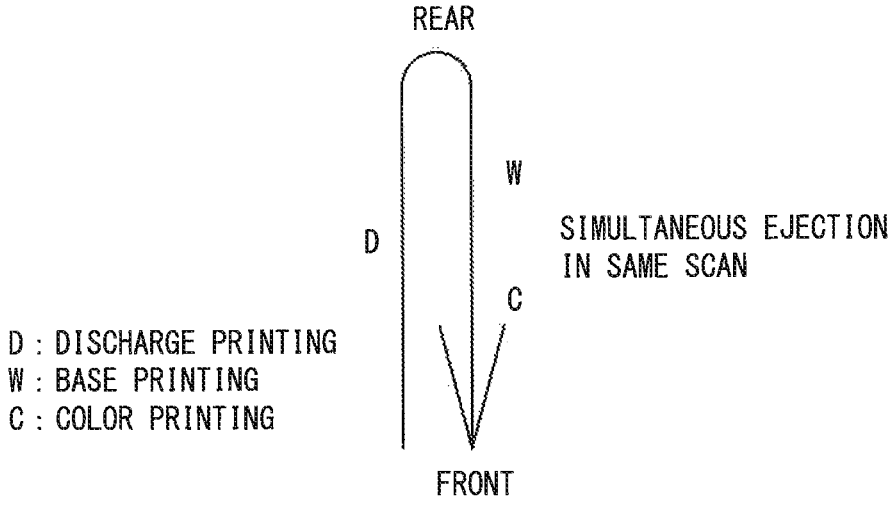
FIG. 29A to FIG. 29C are conceptual diagrams of printing processes.

For example, as shown in FIG. 29A, in the printer 1, when the discharge printing is performed while the platen 5 is conveyed from the front side to the rear side, and the base printing and the color printing are performed while the platen 5 is conveyed from the rear side to the front side, the start position of the discharge printing is located on the rear side of the area A1, and the start position of the base printing and the color printing is located on the front side of the area A1. In this case, at the front side, the user loads the print medium onto the platen 5, and the discharge printing, the base printing, and the color printing can be performed in the one reciprocal movement of the platen 5 in the front-rear direction. Further, since the platen 5 on which the color printed print medium is loaded is on the front side of the printer 1, it is possible to immediately remove the print medium from the platen 5.

Figure 29B:
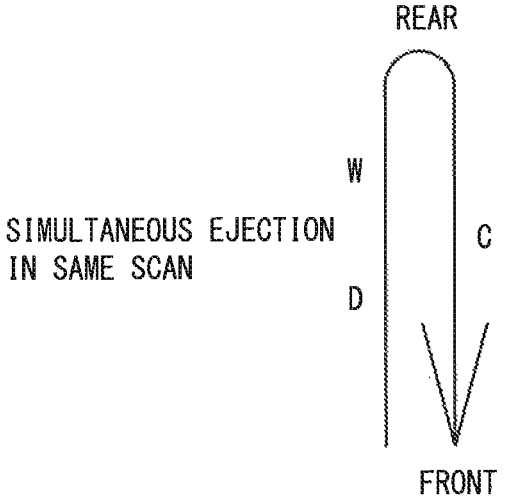

Further, as shown in FIG. 29B, in the printer 1, when the discharge printing and the base printing are performed while the platen 5 is conveyed from the front side to the rear side, and the color printing is performed when the platen 5 is conveyed from the rear side to the front side, the start position of the discharge printing and the base printing is located on the rear side of the area A1, and the start position of the color printing is located on the front side of the area A1. In this case, at the front side, the user loads the print medium onto the platen 5, and the discharge printing, the base printing, and the color printing can be performed in the one reciprocal movement of the platen 5 in the front-rear direction. Further, when the gap between the head 100 and the head 200 is longer than the time over which the platen 5 moves, a time interval between each of the base printing and the color printing can be secured.

Figure 29C:
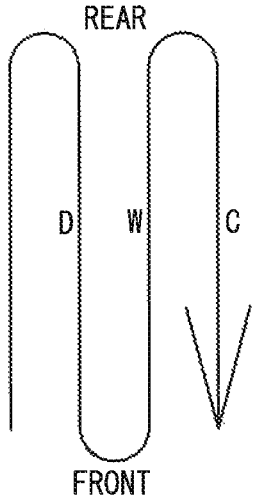

Further, a difficulty of drying the ink depends on an operating environment. Therefore, when it is wished to secure the time interval between each of the discharge printing, the base printing, and the color printing, rather than widening the gap between the head 100, the head 302, and the head 200, even if operating efficiency is lowered, the discharge printing, the base printing, and the color printing are performed in two reciprocal movements of the platen 5 in the front-rear direction. For example, as shown in FIG. 29C, in the printer 1, the discharge printing is performed when the platen 5 is conveyed from the rear side to the front side. Next, the base printing is performed when the platen 5 is conveyed from the front side to the rear side. Next, the color printing is performed when the platen 5 is conveyed from the front side to the rear side. In this case, it is possible to secure the drying time of the ink by widening each of intervals between the discharge printing, the base printing, and the color printing. Note that the discharge printing is performed when the platen 5 is conveyed from the rear to the front in order to visibly check whether a discharge printing section is obtained or not. The final color printing is performed when the platen 5 is conveyed from the rear side to the front side. Thus, the printed print medium can be immediately removed.

Further, one of the scanning position including the discharge printing start position P1 of the head 302, or the scanning position including the discharge printing complete position P4 of the head 302 may be aligned with the scanning position including the printing start position of the head 200 or the head 100. In this case, even if the head 200, the head 100, and the additional head 300 perform printing in exactly the same area, the printing start position of the head 200 or the head 100 need not necessarily be the discharge printing start position P1 by the discharge printing ink head 302. The end portion position P2 of the printing area on the opposite side of the scan, in the scan including the discharge printing start position P1 of the head 302, may be the printing start position of the head 200 or the head 100. The discharge printing complete position P4 of the additional head 300 may be the printing start position of the head 200 or the head 100. The end position P3 of the printing area on the opposite side of the scan, in the scan including the discharge printing complete position P4 of the head 302, may be the printing start position of the head 200 or the head 100. The discharge printing starts from the position P1, but the base printing may start from the position P2 and the color printing may start from the position P4. The start positions may be set while taking into account the print image, the drying time of the ink, and the like as necessary. The stand-by position of the carriage 20A is on the right side, but may be on the left side.

Figure 26:
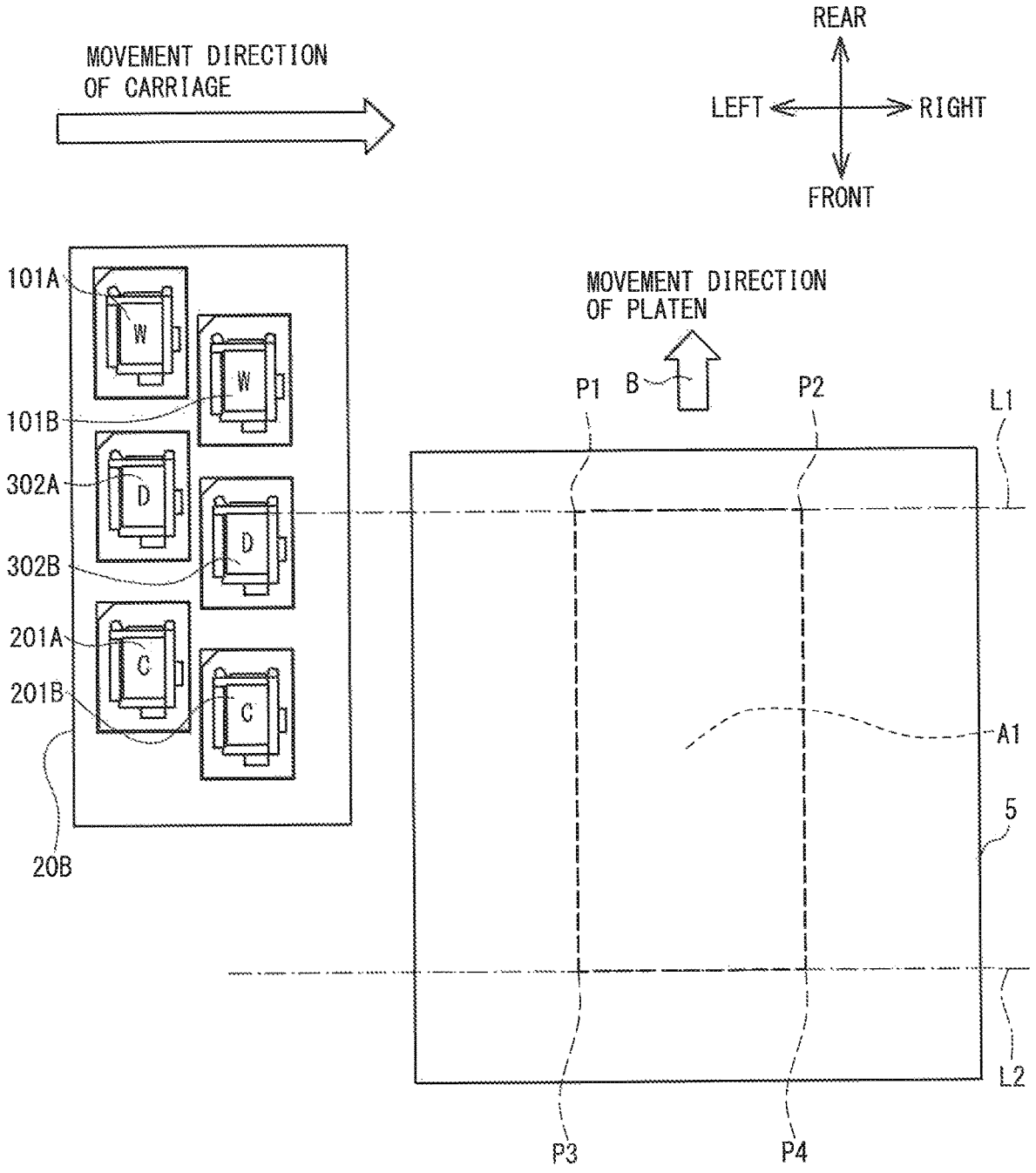
FIG. 26 is a diagram showing the discharge printing start position when a plurality of discharge printing ink heads 302A and 302B are provided in a main scanning direction.
Figure 27:
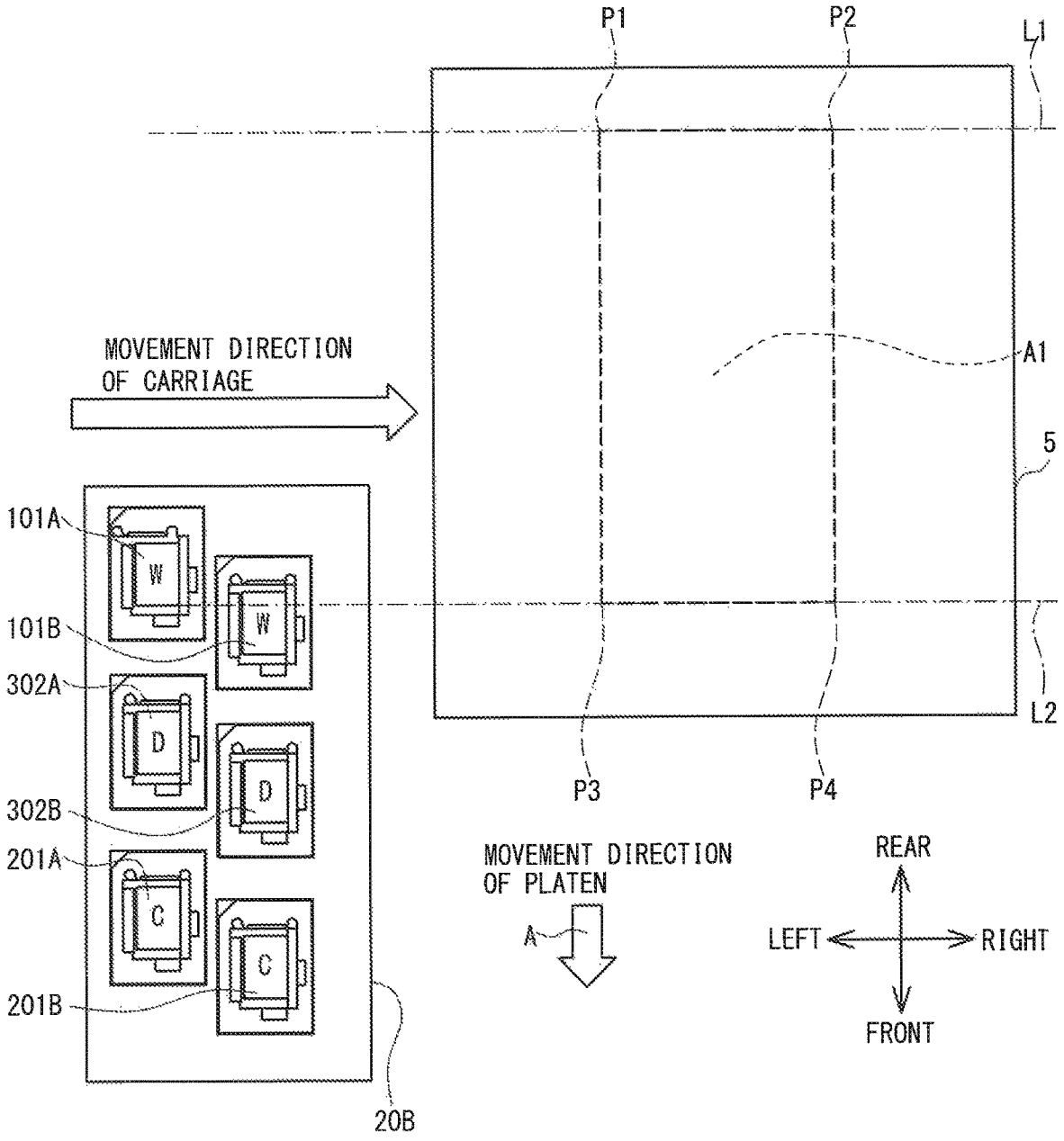
FIG. 27 is a diagram showing the base printing start position when a plurality of white ink heads 101A and 101B are provided in the main scanning direction.
Figure 28:
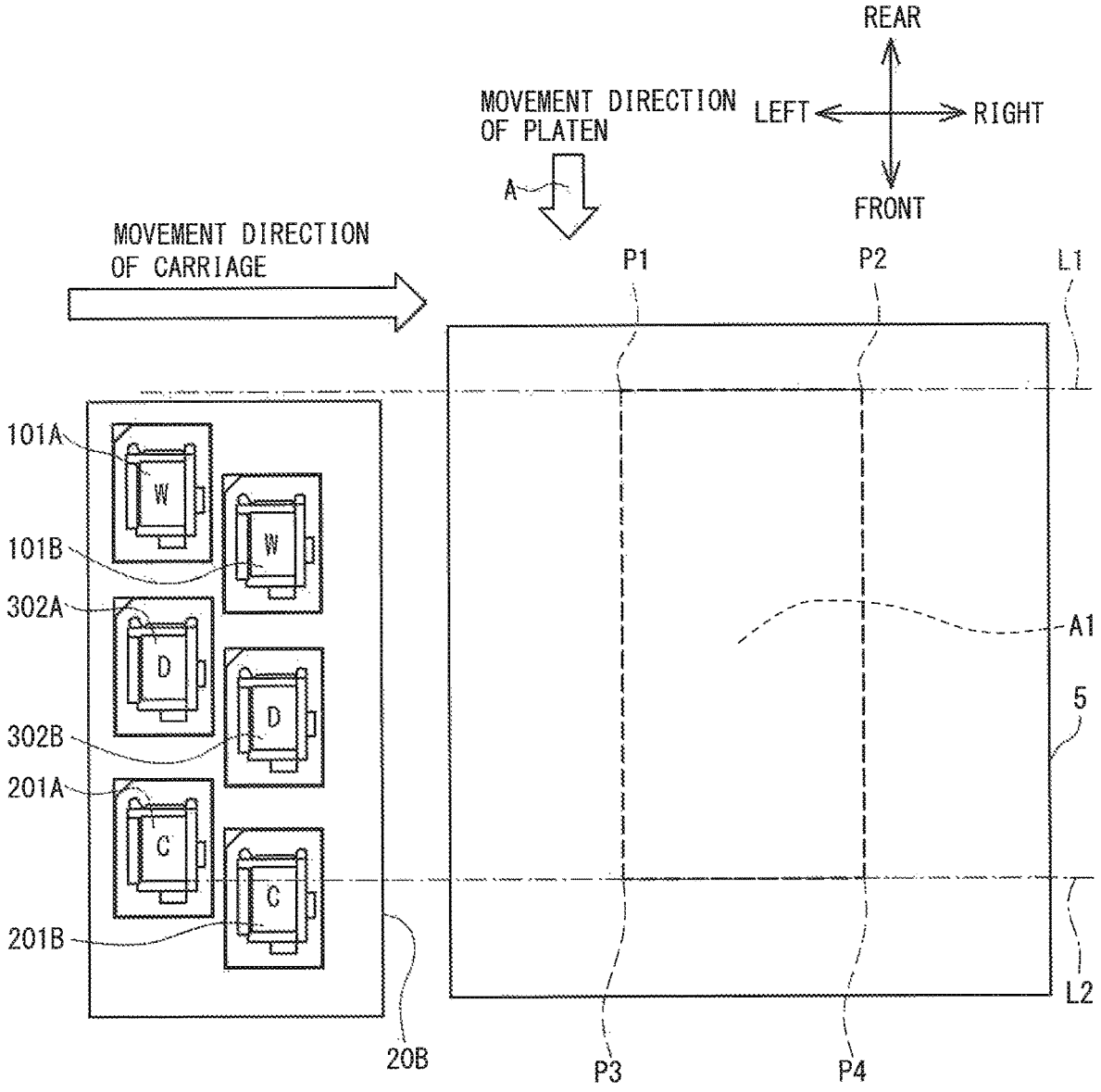
FIG. 28 is a diagram showing the base printing start position when a plurality of color printing heads 201A and 201B are provided in the main scanning direction.

As shown in FIG. 26, FIG. 27, and FIG. 28, in a case in which a plurality of heads of the same type are provided in the main scanning direction of the carriage 20B, and those heads of the same type are disposed in the sub-scanning direction so as to be displaced from each other by a predetermined length, of the heads of the same type, the determination as to which part of which of the heads is the printing start position is made in the following manner. In relation to the printing by the plurality of heads of the same type, the movement direction of the platen 5 in the sub-scanning direction (the direction of the arrow B in FIG. 26, and the direction of the arrow A in FIG. 27 and FIG. 28) is specified. In that movement direction, the side to which the platen 5 moves in accordance with a progression of the printing is referred to as a printing downstream side, and the opposite side is referred to as a printing upstream side. Of the plurality of heads of the same type, the head for which the end of the nozzle arrays on the printing downstream side of each of the heads is furthest to the printing upstream side is specified. Further, in relation to the specified head, the end on the printing downstream side of the nozzle arrays positioned furthest to the printing downstream side may be taken as a reference, and the printing start position may be determined. In FIG. 26, the printing downstream side is the rear side in the drawing, and of the two columns of the heads on the left and the right, the rear side of the discharge printing ink head 302B in the right column is the side that includes the printing start position. The printing downstream side in FIG. 27 and FIG. 28 is the front side in the drawings, and, of the two columns of the heads on the left and the right, the front side of one of the heads in the left column is the side that includes the printing start position. In FIG. 27, the front side of the white ink head 101A, and in FIG. 28, the front side of the color printing head 201A is the side that includes the printing start position.

In the present disclosure, the discharge printing ink is a chemical agent that generates an effect of decoloring an object to be printed, and does not impart color, through any kind of dye or pigment, to the color of the object to be printed. However, the discharge printing ink may be the chemical agent that generates the effect of decoloring the object to be printed, and may also have an effect of imparting color, through any kind of dye or pigment, to the color of the object to be printed. It is essential for the discharge printing ink to have the effect of decoloring the object to be printed, but it is not essential to have the effect of imparting color, through any kind of dye or pigment, to the color of the object to be printed. Note that, of the heads 100 and 101A to 101D, the heads 200 and 201A to 201D, and the additional heads 300, 301, 301A to 301B, 302, and 302A to 302B, any one of the heads may be the head that ejects the white ink, the head that ejects the color ink, the head that ejects the special ink, and the head that ejects the discharge printing ink.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid ejection device, comprising:

a first head configured to eject a first liquid;

a second head configured to eject a second liquid different from the first liquid;

a movement mechanism configured to transport, in a main scanning direction, a carriage on which the first head and the second head are mounted in line with each other in a sub-scanning direction, the first head and the second head being separated from each other in the sub-scanning direction; and an additional head attachment portion being provided between the first head and the second head, and in line with the first head and the second head in the sub-scanning direction on the carriage, the additional head attachment portion being configured to be detachably attached to an additional head.

2. The liquid ejection device according to claim 1, wherein at least one of a maintenance mechanism configured to perform maintenance of the additional head attached to the additional head attachment portion, and a flow path configured to supply ink to the additional head is provided in an increasable manner.

3. The liquid ejection device according to claim 1, further comprising:

a control portion configured to control ejection from each of the first head, the second head, and the additional head, wherein the control portion executes a first printing mode that causes the ejection from each of the first head, the second head, and the additional head and performs the printing, when the movement mechanism transports the carriage in the main scanning direction for one scan.

4. The liquid ejection device according to claim 3, wherein the control portion causes the ejection from at least one head of the first head, the second head, and the additional head, when the control portion moves at least one of a print medium and the carriage to one side in the sub-scanning direction and the movement mechanism transports the carriage in the main scanning direction for one scan, and executes, in accordance with setting, one of the first printing mode and a second printing mode that causes the ejection from the remaining heads, of the first head, the second head, and the additional head and performs the printing, when the control portion moves at least one of the print medium and the carriage to the other side in the sub-scanning direction and the movement mechanism transports the carriage in the main scanning direction for one scan.

5. The liquid ejection device according to claim 1, further comprising:

a control portion configured to control ejection from each of the first head, the second head, and the additional head, wherein the control portion causes the ejection from at least one head of the first head, the second head, and the additional head, when the control portion moves at least one of a print medium and the carriage to one side in the sub-scanning direction and the movement mechanism transports the carriage in the main scanning direction for one scan, and executes a second printing mode that causes the ejection from the remaining heads, of the first head, the second head, and the additional head and performs the printing, when the control portion moves at least one of the print medium and the carriage to the other side in the sub-scanning direction and the movement mechanism transports the carriage in the main scanning direction for one scan.

6. The liquid ejection device according to claim 1, further comprising:

a control portion configured to control ejection from each of the first head, the second head, and the additional head, wherein one of the first head, the second head, and the additional head ejects ink for base printing, and the control portion executes printing by causing the ejection from the heads other than the head that has ejected the ink for the base printing, onto an area in which the ink for base printing has been ejected.

7. The liquid ejection device according to claim 6, wherein one of the first head, the second head, and the additional head ejects, as the ink for the base printing, discharge printing ink that decolors a print medium, and the control portion executes printing by causing the ejection from the heads other than the head that has ejected the discharge printing ink, onto an area in which the discharge printing ink has been ejected.

8. The liquid ejection device according to claim 7, wherein one of the first head, the second head, and the additional head ejects the discharge printing ink that decolors the print medium, and another of the first head, the second head, and the additional head ejects white ink, and the control portion executes printing by causing the ejection of the white ink from the head other than the head that has ejected the discharge printing ink, onto the area in which the discharge printing ink has been ejected.

9. The liquid ejection device according to claim 7, wherein one of the first head, the second head, and the additional head ejects the discharge printing ink that decolors the print medium, and the control portion executes printing while reducing an amount of liquid ejected from at least one of the first head and the second head in comparison to when none of the first head, the second head and the additional head eject the discharge printing ink.

10. The liquid ejection device according to claim 1, wherein:

on the carriage, the first head and the second head are disposed separated from each other in line with the sub-scanning direction, by a distance that is equal to or greater than a length in the sub-scanning direction of a head, of the first head and the second head, for which a length of a nozzle array in the sub-scanning direction is shorter.

11. The liquid ejection device according to claim 1, wherein when

L is a distance between the first head and the second head,

Tpw is a time period required until leading nozzles of the second head print a section printed by leading nozzles of the first head, Tcr is a total time of main scanning, Tw is a wait time, Ln is a length of a nozzle array in the sub-scanning direction, and In is an interlace number, then $L \geq (Tpw \times Ln)/((Tcr+Tw) \times In)$ is established.

12. A liquid ejection device, comprising:

a first head provided with a plurality of first nozzle rows arranged in a main scanning direction, each of the first nozzle row including a plurality of first nozzles arranged in a sub-scanning direction, each of the first nozzles configured to eject a first liquid, the first liquid being a base printing liquid;

a second head provided with a plurality of second nozzle rows arranged in the main scanning direction, each of the second nozzle rows including a plurality of second nozzles arranged in the sub-scanning direction, the plurality of second nozzles in each of the plurality of second nozzle rows configured to eject an ink, onto the base printing liquid, of different color from an ink ejected by any other plurality of second nozzles in any other plurality of second nozzle rows, each of the plurality of second nozzle rows being provided in line with each of the plurality of first nozzle rows in the sub-scanning direction; and an additional head attachment portion being provided between the first head and the second head, and being arranged in line with the first head and the second head in the sub-scanning direction, the additional head attachment portion being configured to be attached to an additional head, the additional head provided with a plurality of third nozzle rows.

13. The liquid ejection device according to claim 12, wherein each of the plurality of third nozzle rows are in line in the sub-scanning direction with the plurality of first nozzle rows and the plurality of second nozzle rows.

* * * * *